175-48
8/11/81 XR 4,282,939

United States Patent [19]
Maus et al.
[11] 4,282,939
[45] Aug. 11, 1981

[54] METHOD AND APPARATUS FOR COMPENSATING WELL CONTROL INSTRUMENTATION FOR THE EFFECTS OF VESSEL HEAVE

[75] Inventors: L. Donald Maus; Jerry M. Speers, both of Houston, Tex.; James D. Howell, Gretna, La.

[73] Assignee: Exxon Production Research Company, Houston, Tex.

[21] Appl. No.: 50,351

[22] Filed: Jun. 20, 1979

[51] Int. Cl.[3] ..... E21B 7/12
[52] U.S. Cl. ..... 175/7; 175/48; 73/155
[58] Field of Search ..... 175/5, 7, 27, 38, 48, 175/50, 321, 72; 73/153, 155; 166/336, 352, 355, 367

[56] References Cited

U.S. PATENT DOCUMENTS

| | | | |
|---|---|---|---|
| 3,602,322 | 8/1971 | Gorsuch | 175/48 |
| 3,760,891 | 9/1973 | Gadbois | 175/48 |
| 3,809,170 | 5/1974 | Ilfrey et al. | 175/7 |
| 3,811,322 | 5/1974 | Swenson | 73/155 |
| 3,815,673 | 6/1974 | Bruce et al. | 175/7 X |
| 3,910,110 | 10/1975 | Jefferies et al. | 73/155 |
| 3,976,148 | 8/1976 | Maus et al. | 175/7 |
| 4,099,536 | 7/1978 | Dower | 137/2 |

*Primary Examiner*—James A. Leppink
*Assistant Examiner*—Richard E. Favreau
*Attorney, Agent, or Firm*—Marc L. Delflache; John C. Hammar

[57] ABSTRACT

A method and apparatus is disclosed for determining the flow rate of drilling fluid flowing from a subaqueous well. The invention may also be used to determine the presence of an abnormal drilling condition during heaving motion of an offshore vessel from which the drilling operation is conducted. The invention measures the volume of fluid passing predetermined locations in the drilling system at particular points in time so as to eliminate the influence that the expansion and contraction of a telescoping section has on the total volume of drilling fluid within the system.

19 Claims, 19 Drawing Figures

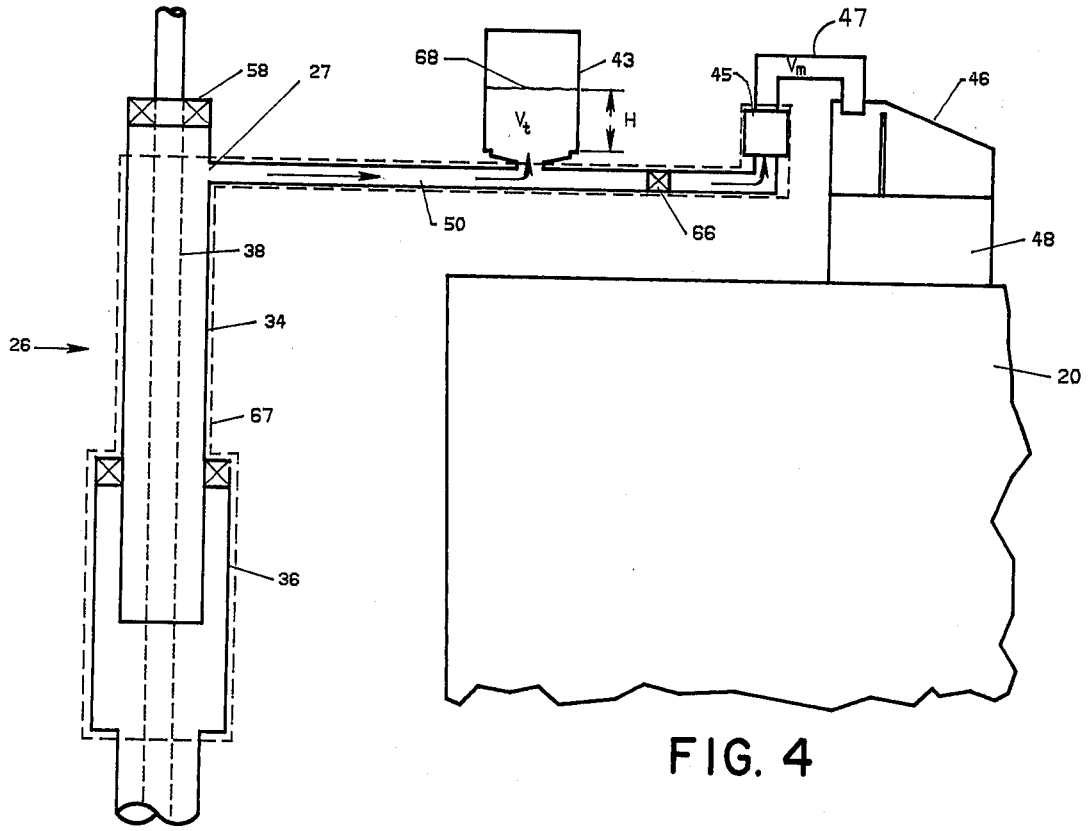
FIG. 4
FIG. 9
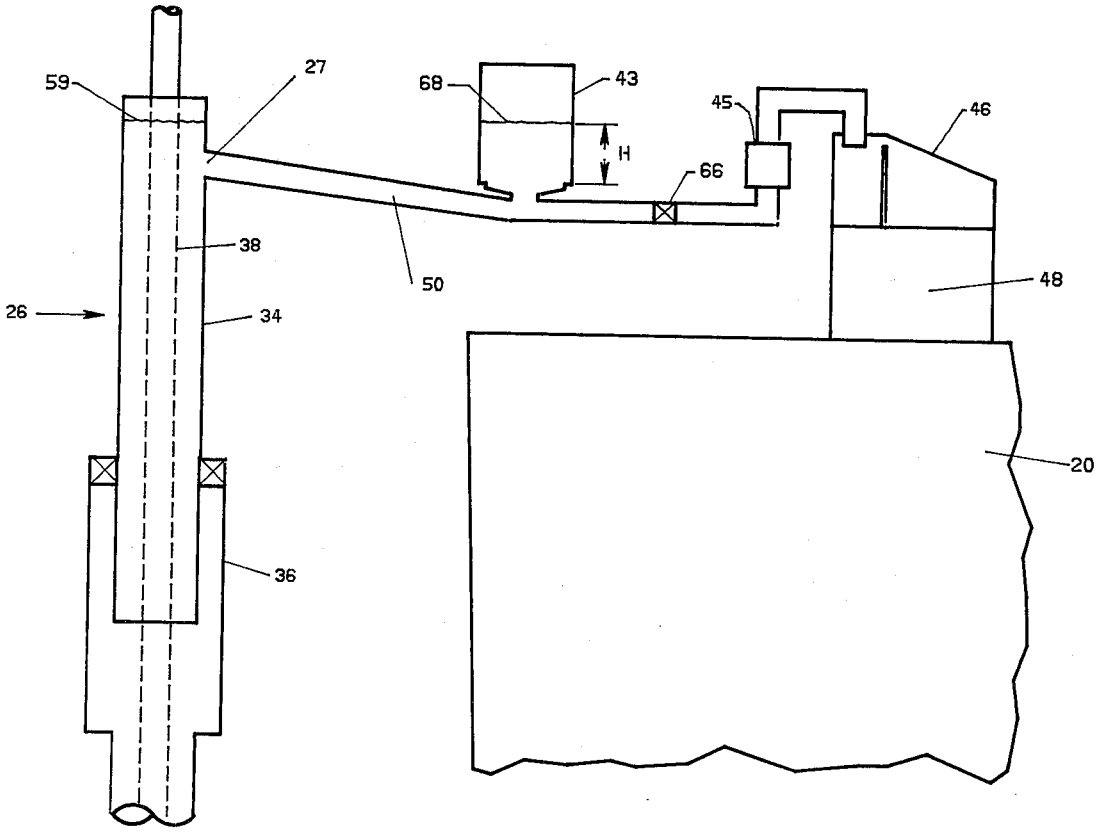

METHOD AND APPARATUS FOR COMPENSATING WELL CONTROL INSTRUMENTATION FOR THE EFFECTS OF VESSEL HEAVE

BACKGROUND OF THE INVENTION

1. Field of the Invention

This invention relates to a method and apparatus for determining the flow of drilling fluid from a subaqueous well and, more particularly, relates to a method and apparatus for determining an abnormal drilling condition such as the initiation of a blowout or the occurrence of lost circulation during heaving or vertical movement of a floating vessel from which the drilling operation is being conducted.

2. Description of the Prior Art

In drilling a well, particularly an oil or gas well, using rotary drilling methods, a hollow drill string extends from the surface to the bottom of the well. A drill bit is attached to the lower end of the drill string. Drilling fluid (mud) is circulated from the surface, through the drill string and orifices in the bit to an annulus defined between the drill string and the inner surface of the well. The mud then circulates upward through the annulus to the surface where it enters one or more tanks for processing (e.g., drill cuttings removed, chemicals added) prior to recirculation into the well.

In a drilling operation, the mud has several functions, the most important being to restrain high pressure fluids within various earth formations. Occasionally, the high pressure fluid intrudes into the well and displaces the mud. This initial intrusion is referred to as a kick. If this occurs, it is important that the pressure condition be balanced as soon as possible; otherwise, the high pressure fluid might flow up the well. This condition is known as a blowout. However, if during the drilling operation a weak earth formation is encountered, the hydrostatic pressure of the mud may fracture the rock and the mud may disperse freely into the formation from the well. This is termed lost circulation.

A blowout is most effectively prevented when the kick or initial intrusion of formation fluid is quickly detected and limited before this fluid displaces a significant amount of mud from the well. Similarly, lost circulation is most effectively limited when the initiation of the loss can be quickly detected and counteracted before a significant amount of the mud has flowed from the well into the formation. Time is of the essence in detecting these abnormal drilling conditions which may become dangerous situations.

Two basic methods are commonly used in the drilling industry to detect kicks or lost circulation. One method is based on a determination of the flow of mud from the well. The second method is based on a determination of the volume of mud displaced from or to the well.

The first method is to determine the rate of flow of drilling mud returning from the well and to compare this rate with either (i) the rate of return mud flow at earlier times or (ii) the rate of mud circulating into the well. The former approach is commonly used and is useful since the rate of circulating mud into the well often remains essentially constant for long periods of time. The latter approach has the advantage of compensating automatically for normal changes in mud circulating rate. An increase in the return flow rate of mud from the well above an equivalent increase in the rate of circulation into the well is an indication of a kick. Similarly, an unexplained decrease in the return flow rate is an indication of lost circulation.

The second basic method centers on the determination of the volume of drilling mud contained in mud tanks at the surface which are in fluid communication with the well. These tanks generally fall into one of two categories—active tanks or trip tanks.

Active tanks are those through which mud is circulated for removal of drilled solids and other treatment prior to recirculation. The volume in the active tanks is responsive to differences between the volume of mud pumped into the well and the volume returning from the well. Although a number of normal processes may affect this volume (removal of drilled solids, addition of water or other materials), an unexplained increase in the volume is an indication of a kick while an unexplained decrease is an indication of lost circulation.

The trip tanks are usually much smaller than the active tanks and, therefore, much more sensitive to changes in mud volume. They are connected to the well during periods when no mud is being circulated into the well through the drill string. Such non-circulating periods include (i) times when a kick is suspected and the mud circulation is stopped to conclusively determine if the well is flowing and (ii) times when the drill string is being removed from or returned to the well. This latter operation is known as a trip, hence, the name "trip tank". During trips, the change in volume of the mud in the trip tank is compared with the displacement expected due to insertion or removal of a given length of drill string into or from the well. In this manner, unexplained increases or decreases in trip tank volume may be interpreted as kicks or lost circulation, respectively.

Unfortunately, drilling offshore wells from a floating vessel complicates the monitoring of the return mud rate or surface mud volume. The drilling vessel is connected to the well by a marine riser which serves as an extension of the well between the sea floor and the vessel. The mud returns to the vessel from the well through an annulus defined between the outer surface of the drill string and the inner surface of the marine riser. In order to accommodate the heaving or vertical motion of the vessel, the marine riser usually includes a telescoping section or slip joint.

At sea, the heaving motion of the vessel oscillates the telescoping section thereby extending and contracting it. In this manner, the lower section (below the telescoping section) of the marine riser remains stationary with respect to the sea floor while the upper section of the marine riser oscillates with the vessel. The oscillating motion of the telescoping section increases and decreases the volume of the annulus and, hence, the volume of the mud in the annulus returning from the well. The resulting variations in the annular volume of the telescoping section affect the measurements of the flow from the well if one wishes to monitor the flow above the telescoping section. Typically, this is the case since it is currently impractical to measure the flow in the marine riser below the telescoping section due to the difficulties associated with a rotating drill string.

The maximum and minimum flow rate of the mud induced by the extension and contraction of the marine riser may be several times larger or smaller than the actual or true flow rate from the well. For example, variations may occur in the measured return flow rate of mud from 2000 gallons per minute (gpm) in the reverse direction (when the telescoping section is expanding) to about 5000 gpm in the normal direction (when the telescoping section is contracting) compared to a true return flow rate of mud from the well of about 1500 gpm. In addition, the variations in the volume of mud in the telescoping section induces variations in the volume of mud contained in those tanks in fluid communication with the riser. These variations complicate an accurate assessment of increases or decreases in the tank volume. Therefore, the cyclic variations in the volume of the marine riser caused by the movement of the vessel complicates an accurate assessment of an abnormal drilling condition. The rapid determination of a blowout or lost circulation condition is very difficult without a means to correct for the effects of the variation in the length of the telescoping section if one wishes to monitor the return mud flow or volume above the telescoping section.

Gorsuch, in his U.S. Pat. No. 3,602,322, discloses a system for sensing a variation between the input and output flows of a well above some defined tolerable range. Gorsuch's system is one of the more elementary patents in the field for determining a blowout or lost circulation. However, its application is limited to a motionless system, e.g. onshore. The Gorsuch system cannot effectively deal with variations in the return flow rate of drilling fluid resulting from the heaving motion of the vessel.

The following U.S. Patents have recognized the problem of accurately assessing the true flow rate of the returning drilling fluid when monitoring the flow rate from above the telescoping joint due to the heaving motion of the offshore vessel:

U.S. Pat. No. 3,760,891—Gadbois
U.S. Pat.No. 3,910,110—Jefferies et al
U.S. Pat. No. 3,976,148—Maus et al The Gadbois system monitors the return flow rate of the mud at the vessel and generates an electrical signal porportional to that return rate. The signal is then monitored and accummulated over preselected, overlapping time intervals and compared with threshold values to determine the occurrence of a kick or lost circulation. The Gadbois system requires the preselection of a time interval over which the accummulation is performed. The time interval is constant. The Gadbois system, however, does not provide for the monitoring of a telescoping section over time periods such that the effect on the final determination of the flow of mud from the well due to the expansion and contraction of the telescoping section is eliminated.

Jefferies et al (U.S. Pat. No. 3,910,110) discloses a system for detecting a kick or lost circulation in a subaqueous well in which the return rate of the mud flowing back to the vessel from the well is measured and an electrical signal is generated proportional to that rate of flow. The electrical signal is modified to compenste for rates of change in the mud volume within the telescoping section. The modified electrical signal is then compared with a second electrical signal proportional to the rate of flow of the mud into the well. U.S. Pat. No. 3,910,110 discloses a system for continuously modifying the electrical signal which compensates for a change in the volume of the flow path caused by the heaving motion of the vessel.

Maus et al (U.S. Pat. No. 3,976,148) also discloses a method and apparatus for determining on board a heaving vessel the flow rate of drilling mud flowing from a well. However in the Maus disclosure, a first, second and third electrical signal are generated which correspond, respectively, to (i) a flow rate of mud flowing through a conduit downstream the telescoping section, (ii) a rate of change in the volume of mud contained within the riser above the point at which the conduit between the mud processing system and riser intersects the riser, and (iii) a rate of change in the volume of the mud in the telescoping section. The first, second and third signals are then correlated to produce a fourth electrical signal proportional to the flow rate of the mud flowing out of the well into the marine riser. U.S. Pat. No. 3,976,148, however, requires the continuous monitoring of the extension and contraction of the telescoping section to accurately assess the rate of change in the volume of the drilling fluid passing through the marine riser.

Other background references of a general interest relating to heave compensation systems and pressure control of drilling fluid returns are;

U.S. Pat. No. 3,809,170—Ilfrey et al.
U.S. Pat. No. 3,811,322—Swenson
U.S. Pat. No. 3,815,673—Bruce et al.
U.S. Pat. No. 3,946,559—Stevenson
U.S. Pat. No. 4,085,509—Bell et al.
U.S. Pat. No. 4,099,536—Dower
U.S. Pat. No. 4,099,582—Bell
U.S. Pat. No. 4,121,806—Iato et al.
U.S. Pat. No. 4,138,886—Lutz et al.

SUMMARY OF THE INVENTION

The present invention comprises a method and apparatus for determining an abnormal drilling condition by determining the intrusion of formation fluids into a well or the loss of drilling fluid or mud from a well. Specifically, the present invention comprises a method and apparatus for determining the flow of drilling fluid flowing from a subaqueous well. The present invention relates to offshore drilling from a floating vessel having a marine riser which connects the vessel with the well. A mud system is connected to the riser by means of a conduit. The marine riser includes a telescoping or slip joint section having an upper and lower cylinder relatively displaceable to accommodate vertical or heave movement of the vessel. More specifically, the present invention is concerned with determing the flow rate of drilling fluid flowing from the telescoping section.

Briefly, the present invention comprises the step of measuring the volume of drilling fluid flowing from the telescoping section during the time period in which the telescoping section moves from a predetermined reference position and returns to that predetermined reference position. The reference position is a preselected relative position of the upper cylinder with respect to the lower cylinder. Thus, the volume of mud within the telescoping section at the reference position is always constant due to the preselected relative position of the two cylinders.

It is another feature of the present method to determine the particular times at which the telescoping section is in the reference position since the volume of mud contained within the telescoping section at these times is the same. In this manner, time periods or intervals are defined between those successive points in time which indicate the occurrence of the predetermined reference position. Thus, the flow of mud from the marine riser, when averaged over one or more such time periods is unaffected by vessel heave. The volume of mud contained in any tank in close fluid communication with the marine riser, when measured at these particular points in time, is also unaffected by vessel heave. In other words, the volume in the telescoping section at successive occurrences of the predeterminedreference position is unaffected by vessel heave, eliminating the need to measure this volume and, consequently, correct for a change in this volume (as required in U.S. Pat. Nos. 3,918,110 and 3,976,148) in determining either the flow of the mud leaving the well or the volume in the surface mud tanks.

The present invention is applicable to various configurations of piping between the marine riser and the mud processing system. In one configuration the conduit connecting the marine riser with the mud tanks is kept continuously full of drilling mud. In this manner, errors which might result due to variations in mud volume in the conduit between the marine riser and the point of flow or volume measurement are minimized.

In another configuration, a surge means is used in fluid communication with the conduit to attenuate the magnitude of variations in the flow of drilling fluid caused by the extension and contraction of the telescoping section during the heaving motion. When employing a surge means, the measurement of the volume of drilling fluid flowing downstream the telescoping section by means of the present invention is preferably measured downstream the surge means itself. The flow variations downstream the surge means are substantially less than if a surge means were absent due to the attenuating action of the surge means. Thus, when a surge means is employed, the method of the present invention comprises the step of measuring a change in the volume within the surge means during the same time period that the flow downstream the surge means is measured. The summation of the volume change in the surge means and the volume passing the meter downstream the surge means is the desired volume of mud flowing from the marine riser.

In another configuration, the surge means is utilized as a trip tank. A valve is mounted within the conduit downstream the surge means. When mud is not being circulated into the well, the valve is closed thereby preventing flow through a meter downstream the surge means. The volume of mud in the surge means, when measured at those points in time indicative of the reference position is, therefore, unaffected by the heaving motion of the vessel. Thus, unexplained increases or decreases in this volume can be detected more rapidly than heretofore possible.

In a preferred embodiment of the present invention, applicable to piping configurations with or without a surge means, the time period between successive reference positions is measured. The measured volume of mud passing the flow meter (summed with the change in volume of the mud within the surge means, if used) during a particular time period is divided by the same time period to determine the average rate of flow of mud from the marine riser.

In another embodiment of the present invention, the volume of mud contained within the active mud tanks is measured at the specific times the telescoping section is in the reference position. The piping configuration may or may not contain a surge means upstream of the active mud tanks. If a surge means is used, the volume of mud within it is also determined at the reference position and summed with the volume in the active tanks.

It is a feature of the preferred embodiment, however, not to limit itself to a single time period, but rather generate successive time periods between successive signals. A signal is generated each time the relative position of the upper and lower cylinders is at the predetermined relative position. Each signal would terminate a previous time period and initiate the subsequent one. Indeed, the invention is not limited to equal time periods. The duration of each time period is insignificant since the invention discretely selects, by monitoring the telescoping section, time periods such that change in the volumetric displacement of the telescoping section due to heaving motion is eliminated. As used herein, "successive" is distinguishable from "consecutive" in that the invention is not limited to immediately adjacent time periods. The invention may be practiced over multiple time periods defined to be between a predetermined number of signals.

In practicing the invention, successive time periods may be correlated with their respective volumetric measurements. A single clock may record successive readings or alternatively, a series of clocks each designed to initiate and terminate several meters, may successively measure the change in volume of the surge means and the volume of drilling fluid flowing downstream of the surge means.

The improved apparatus for determining the flow of drilling fluid flowing from a subaqueous well comprises, initially, a means for sensing the relative position of the upper and lower cylinders with respect to a predetermined relative position. The sensing means emits a signal each time the cylinders are momentarily in the predetermined position. The apparatus also includes a clock which measures the time between successive signals defining a time period or interval. In addition, the apparatus includes a means for measuring the volume of drilling fluid flowing downstream the telescoping section within said time period. In this manner, the flow rate of drilling fluid flowing from the well is determined by dividing the measured volume of drilling fluid flowing downstream the telescoping section by the respective time period in which that measurement was made.

In a modification of the apparatus, the measuring means includes the ability to monitor, in series, a plurality of volumetric measurements over successive time periods thereby enabling the calculation of a series of flow rates flowing from the well by dividing each volumetric measurement by its respective time period.

In determining a kick or lost circulation, the apparatus may include a means for measuring the volume of drilling fluid entering the marine riser from the mud system during the time period. In this manner, the occurrence of a kick or lost circulation is indicated by a difference between the measured volume of drilling fluid flowing downstream the telescoping section and the measured volume of drilling fluid flowing into the well from the mud system. In making this determination, however, both measurements of volumetric flow must be made during the same time period.

In another modification of the apparatus in which a surge means is included on the heave system, the improved apparatus would include a means for measuring a change in the volume of the drilling fluid within the surge means. The volume in the surge means would be measured at those points in time wherein the telescoping section is in the predetermined reference position. Successive readings would be compared to assess a change in the volume. The volume of drilling fluid flowing from the well is also measured downstream the surge means. Therefore, in determining the presence of an abnormal drilling condition, a difference between the measured volume of the drilling fluid entering the riser from the mud system and the summation of the measured volume of the drilling fluid flowing downstream the surge means and the measured change in the volume of the drilling fluid within the surge means, all measured during the identical time period, is an indication of either a kick or lost circulation. If a trip were made, the improved apparatus would monitor merely the volume of the drilling fluid in the surge means to determine if a change were occurring which might indicate either a kick or loss of circulation.

BRIEF DESCRIPTION OF THE FIGURES AND TABLES

In order that the features of this invention may be better understood, a detailed description of the invention as illustrated in the attached figures and tables follows:

FIG. 4 is another configuration of a drilling fluid circulating system employing a rotating seal atop the marine riser and a surge tank in communication with the conduit.

FIG. 9 is yet another configuration of a drilling fluid circulating system modified to employ the present invention. It is similar in structure to FIG. 4 excepting the absence of the rotating seal.

TABLE 1 is a tabulation of data assimilated from the Design Example

TABLE 1

| t** | t** (sec) | H** (ft) | ΔH* (ft) | $\Delta V_t$* (gal) | $V_m$* (gal) | $V_{ret}$* (gal) | Δt* (sec) | $Q_{ret}$* (gal/min) |
|---|---|---|---|---|---|---|---|---|
| $t_0$ | 0 | −.1691 | | | | | | |
| $t_1$ | 7.50 | +.0671 | +.2362 | +12.52 | 62.48 | 75.0 | 7.50 | 600 |
| $t_2$ | 9.49 | +.0303 | −.0368 | −1.95 | 21.85 | 19.9 | 1.99 | 600 |
| $t_3$ | 13.70 | +.1551 | +.1248 | +6.61 | 35.49 | 42.1 | 4.21 | 600 |
| $t_4$ | 15.00 | +.1232 | −.0319 | −1.69 | 14.69 | 13.0 | 1.30 | 600 |
| $t_5$ | 16.30 | +.1050 | −.0182 | −0.96 | 13.96 | 13.0 | 1.30 | 600 |
| $t_6$ | 20.51 | −.0655 | −.1705 | −9.04 | 51.14 | 42.1 | 4.21 | 600 |
| $t_7$ | 22.50 | −.0215 | +.0440 | +2.33 | 17.57 | 19.9 | 1.99 | 600 |
| $t_8$ | 30.00 | −.1691 | −.1476 | −7.83 | 82.83 | 75.0 | 7.50 | 600 |

TABLE 2 is a portion of the same data presented in TABLE 1 yet computed over different time intervals.

TABLE 2

| t** | t** (sec) | H** (ft) | ΔH* (ft) | $\Delta V_t$* (gal) | $V_m$* (gal) | $V_{ret}$* (gal) | Δt* (sec) | $Q_{ret}$* (gal/min) |
|---|---|---|---|---|---|---|---|---|
| $t_0$ | 0 | −.1691 | | | | | | |
| $t_2$ | 9.49 | +.0303 | +.1994 | +10.57 | 84.33 | 94.9 | 9.49 | 600 |
| $t_4$ | 15.00 | +.1232 | +.0929 | +4.92 | 50.18 | 55.1 | 5.51 | 600 |
| $t_6$ | 20.51 | −.0655 | −.1887 | −10.00 | 65.10 | 55.1 | 5.51 | 600 |
| $t_8$ | 30.00 | −.1691 | −.1036 | −5.49 | 100.39 | 94.9 | 9.49 | 600 |

DETAILED DESCRIPTION OF THE INVENTION

Figure 1:
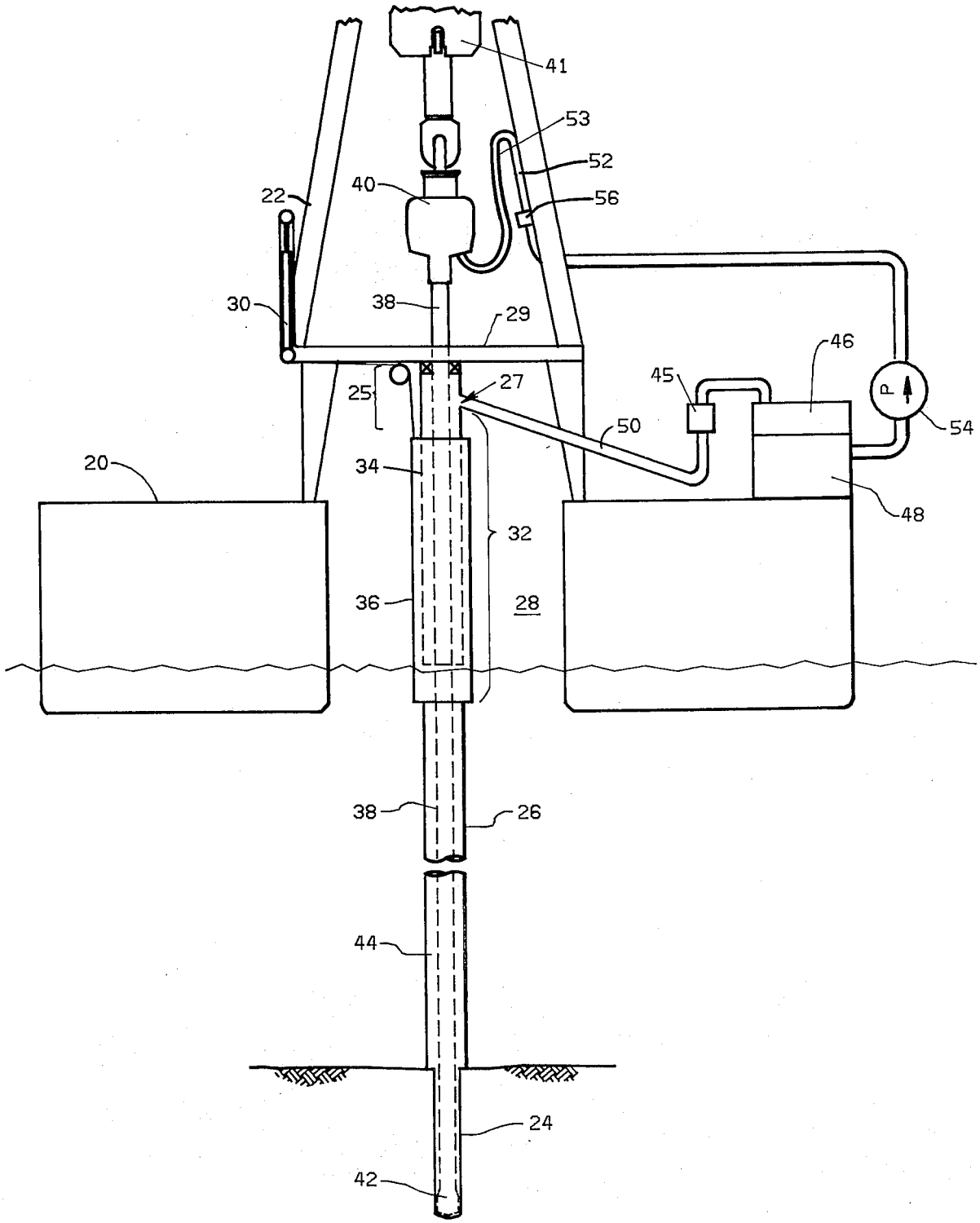
FIG. 1 is an elevation view of an offshore floating vessel drilling a subaqueous well utilizing a conventional drilling fluid circulating system.

Referring now to FIGS. 1–12, TABLES 1 and 2, and with particular reference to FIG. 1, a vessel 20 is illustrated having a derrick 22 and derrick floor 29 mounted on the vessel 20 for subaqueous drilling of a well 24 (also referred to as a well bore) offshore. The vessel is connected to the well by means of a marine riser 26 which extends from the derrick floor 29 through a moon pool 28 in the hull of the vessel 20 to the well bore at the sea floor. The marine riser 26 is connected to the well 24 with typical blowout preventive equipment (not shown) well known in the art. The marine riser is connected at its upper end to the derrick floor 29 by means of a riser-tensioning apparatus 30 which provides the upward force necessary to support the riser.

The marine riser 26 also includes a telescoping section or slip joint 32 near its upper end. This telescoping section comprises upper and lower cylinders 34, 36 mounted for relative telescopic movement such that the upper cylinder 34 moves within the lower cyliner 36 during the vertical or heave movement of the vessel 20 due to the wave, tide and current influences. The tensioners 30 attach to the upper end of the lower cylinder 36. In this manner, the vertical motion of the vessel is compensated for by the tensioners 30. Tensioners are well known in the art. For example, NL Shaffer's Riser Tensioner illustrated at page 4951 of Vol. III of the *Composite Catalogue of Oil Field Equipment and Services,* 1978–1979 ed. published by World Oil. The upper cylinder 34 strokes inside the lower cylinder 36 as the vessel oscillates. The lower cylinder 36 remains stationary with respect to the sea floor.

A drill string 38 is supported from a swivel 40 which is, in turn supported by a motion compensator 41 within the derrick 22. An example of a motion compensator is NL Shaffer's Drill String Compensator illustrated at page 4945 of Vol. III of the *Composite Catalogue of Oil Field Equipment and Services.* The drill string 38 extends downwardly through the marine riser 26 into the well as illustrated by the dashed lines. A drill bit 42 which is used to drill the well is secured at the lower end of the drill string 38. An annulus 44, defined by the inner surface of the marine riser 26 and the outer surface of the drill string 38, provides a return flow path for the drilling mud. A conduit 50 intersects the upper portion 25 of the riser 26 generally below the derrick floor 29, and extends to a shale shaker 46 and active mud tanks 48.

A flow meter 45 is mounted on the conduit 50 between the riser 26 and the shale shaker 46. The flow meter 45 measures the rate or volume of mud flowing toward the shale shaker 46. Measuring devices (not shown) which are discussed in greater detail below, are included to measure the volume of mud in the active tanks 48. A standpipe 52 extends from the shale shaker 46 to a flexible hose 53 which in turn connects to the swivel 40 within the derrick. A flow meter 56 is mounted on the standpipe to measure the rate or volume of mud being injected into the drill string 38. A pump 54 takes suction from the active tanks 48 and circulates mud up the standpipe 52 through the flexible hose 53, to the swivel 40, down the drill string 38 toward the bit 42 and back to the vessel through the annulus 44. The returning mud exits the annulus thrugh an aperture 27 in the riser 26 into the conduit 50 and flows to the shale shaker 46 where the solids are screened out and the mud is returned to the active tanks 48.

The mud exits the drill string 38 through the bit 42 flushing out solids resulting from the drilling action of the bit while simultaneously cooling the bit. The drilled solids are suspended in the mud and are carried back to the vessel in the return flow up the annulus 44. In order to maintain sufficient hydrostatic pressure on the subterranean formations being drilled, the annulus 44 is maintained continuously full of mud.

As discussed previously, an abnormal drilling condition such as a kick or lost circulation is detected by observing unexplained changes in either the return rate of mud flowing from the marine riser 26 or the volume of drilling mud in the active mud tanks 48. In a stable state, e.g. on shore, the flow rate measured by the meter 45 and the mud volume measured by instruments (not shown) in tanks 48 are sufficient for indicating a kick or lost circulation. An example of a mud volume measuring instrument, which is well known in the art, is the Mud Volume Totalizer, Series MVTX, manufactured by the Martin-Decker Company of Santa Ana, California. In an ocean environment where having movement of the vessel 20 displaces the upper cylinder 34 of the telescoping section 32 with respect to the lower cylinder 36, significant volumetric changes occur which substantially affect these measurements and limit the ability to detect potential well control problems.

Figure 2:
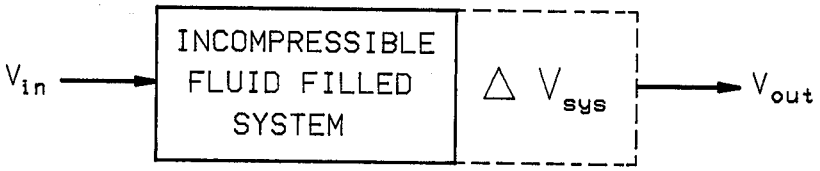
FIG. 2 is a block diagram schematically illustrating the passing of drilling fluid within the marine riser and undergoing volumetric changes within a telescoping section of the marine riser due to the heaving motion of the vessel.

By referring to FIG. 2, the phenomena which the marine riser is actually undergoing is better appreciated. FIG. 2 diagramatically indicates that, in any given period of time, the total volume of incompressible fluid ($V_{in}$) added to a saturated fluid system is equal to the total volume removed from the system ($V_{out}$) plus any increase in the volume of the fluid within the system ($\Delta V_{sys}$). This relationship is mathematically represented as:

$$V_{in} = V_{out} + \Delta V_{sys} \quad (1)$$

Equation (1) can be applied to the entire mud circulating system as shown in FIG. 1 or to any portion of it. For example, in analyzing the effect of vessel heave, $V_{in}$ would be the volume of mud entering the bottom of the telescoping section 32 and $V_{out}$ would be the volume of mud flowing past the flow meter 45. Therefore, $\Delta V_{sys}$ would be the change in the volume of mud in the flow path between these two locations.

Figure 3:
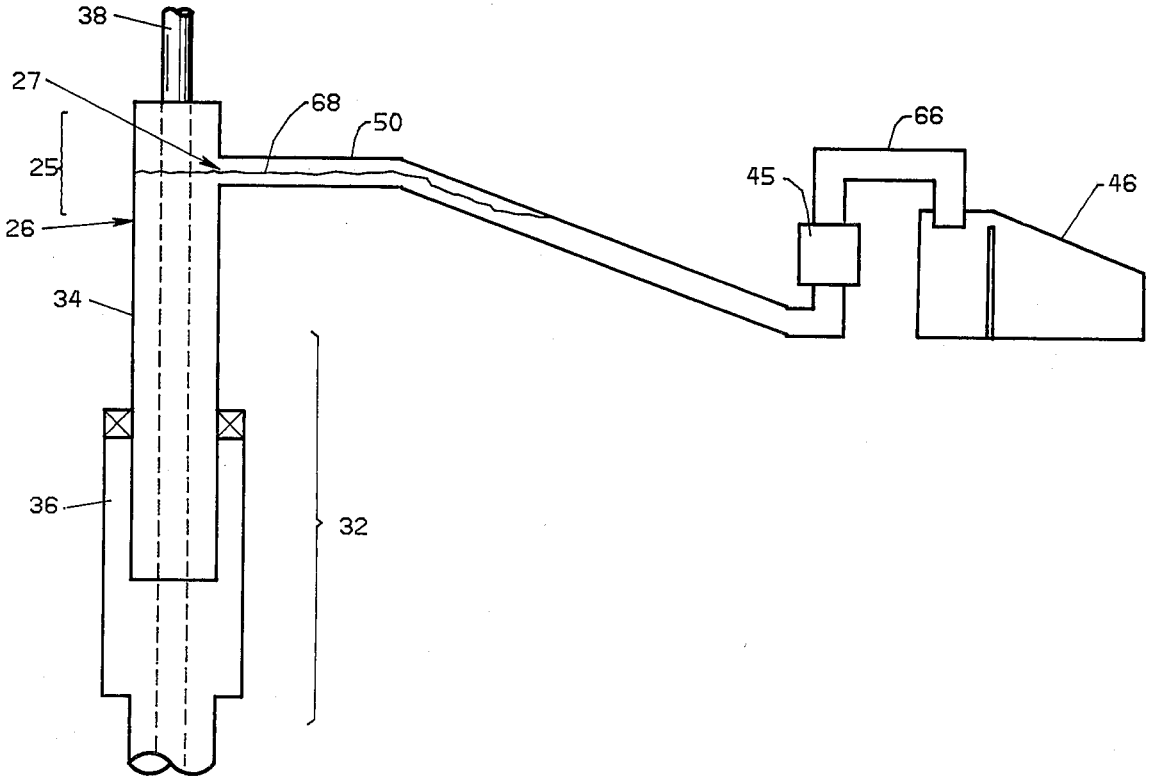
FIG. 3 is an expanded elevation view of that portion of the drilling fluid circulating system of FIG. 1 to which the present invention applies.

FIG. 3 is an enlarged drawing of a portion of the circulating system of FIG. 1. As shown, the position of the aperture 27 of the marine riser relative to the shale shaker 46 is such that portions of the conduit 50, as well as the upper part 25 of the marine riser 26 may only be partially full of mud. A free surface 68 exists within these components and this surface varies in elevation in response to the flow surges caused by vessel heave. Therefore, the term $\Delta V_{sys}$ for this system includes not only the volume changes within the telescoping section 32, but also the changes in mud volume within the upper part 25 of the marine riser 26 and the conduit 50. Because of the generally uniform cross section of the telescoping section 32, it is well known in the prior art to relate the volume of mud within it to its overall length, which is easily measured. However, the complex relationship between the free surface 68 and the volume of mud contained within the upper part 25 of marine riser 26 and conduit 50 makes it impractical to measure this volume.

The prior art, particularly Jefferies (U.S. Pat. No. 3,910,110) and Maus (U.S. Pat. No. 3,976,148), teaches the modification of the flow path between the telescoping section 32 and the flow meter 45 to either eliminate the free surface 68 (U.S. Pat. No. 3,910,110) or create a geometry wherein the conduit 50 remains full of mud at all times and the free surface 68 exists only in the upper part 25 of marine riser 26 above the aperture 27 (U.S. Pat. No. 3,976,148).

The prior art, particularly U.S. Pat. No. 3,976,148, teaches the determination of the flow rate of drilling fluid entering the bottom of the telescoping section according to the following equation:

$$Q_{in} = Q_{out} + (dV_{sys}/dt) \quad (2)$$

where $Q_{in}$ denotes the flow rate of drilling fluid entering the bottom of the telescoping section, $Q_{out}$ represents the flow rate of fluid passing through a flow meter in the conduit 50, and dVsys/dt represents the continuous change in the volume of mud in both the telescoping section 32 and upper marine riser 25 as a function of time. In U.S. Pat. No. 3,976,148, both the length of the telescoping section and the mud level above the intersection of the conduit 50 and the riser are continuously monitored to directly yield a change in the flow rate.

The present invention, which employs equation (1) in solving for $V_{in}$, depends on measuring $V_{out}$ during particular time intervals chosen such that $\Delta V$ is zero. In this manner, the measured volume $V_{out}$ is an accurate indication of the volume entering the telescoping section, $V_{in}$, during the particular time intervals. The average rate of flow of drilling fluid entering the telescoping section may then be determined by dividing $V_{out}$ by the length of the time interval or period over which the volumetric measurement was made. Thus, the calculated average flow rate past the meter 45 is substantially equal to the flow rate entering the bottom of the telescoping section 32 and is unaffected by vessel heave.

Alternatively, the volume of mud contained in tanks in fluid communication with the marine riser can be measured at particular times such that $\Delta V_{sys}$ is zero and the volume measured is, thus, unaffected by heave.

FIG. 4 is a simplified drawing of an elevation view of a preferred piping configuration with which the present invention may be employed. The upper section of marine riser 26 includes the upper and lower cylinders 34, 36 of the telescoping section. The conduit 50 intersects the marine riser 26 at aperture 27 and extends to a shale shaker 46. The annulus area between the upper portion 25 of marine riser 26 and the drill string 38 is sealed by means of a rotating seal 58 such as the "Rotating Blowout Preventer" manufactured by N. L. Shaffer of Houston, Texas and illustrated in detail on page 4914 of Vol. III of the *Composite Catalog of Oil Field Equipment and Services.* A surge tank 43 is in fluid communication with the conduit 50 upstream of the shale shaker 46. As shown in FIG. 4, the surge tank 43 is connected directly to the conduit 50; however, the tank 43 may be connected directly to the riser 26 via an outlet similar to aperture 27. A level sensor (not shown, but for example, the Universal Trip Tank Monitoring System Series TTSX, manufactured by the Martin-Decker Company of Santa Ana, California) measures the height H of the free mud surface 68 in the surge tank 43. A flow meter 45 is mounted on the conduit 50, preferably downstream of the surge tank 43. The configuration of the conduit 50 in the vicinity of the flow meter 45 is chosen to maximize the accuracy of the flow meter by maintaining the meter full of fluid at all times and reducing the possibility of settled solids blocking part of the meter flow area. The illustrated configuration is predicated on the use of an electromagnetic-type flow meter such as the Model 10D1435A/V Magnetic Flow Meter manufactured by Fischer & Porter Company of Warminster, Pennsylvania. Alternatively, a paddle-type flow meter such as the "Flo-Sho" manufactured by Warren Automatic Tool Company of Houston, Texas might be employed in a horizontal portion 47 of conduit 50 provided it is configured to operate pratically full of fluid. Active mud tanks 48 receive the muds after passing through shale shaker 46. These tanks also contain a level sensor such as Martin-Decker's TTSX system. A valve 66 is located in conduit 50 downstream of surge tank 43.

The relative elevations of the seal 58, conduit 50, surge tank 43 and shale shaker 46 are chosen so that the mud surface 68 in the surge tank 43 is the only free surface in the system. All other components upstream of the flow meter 45 remain full of mud at all times.

The surge tank 43 attenuates the magnitude of the surges experienced by the flow meter 45, shale shaker 46 and active tanks 48. This is desirable since the unattentuated heave-induced surges resulting from the expansion and contraction of the telescoping section may be several times greater than the normal flow as previously illustrated. By attenuating these surges, the components need not be designed to handle these extreme magnitudes.

The present invention may be practiced on the configuration illustrated in FIG. 4 to compensate for vessel heave when either a flow measurement system or a volume measurement system is used. The invention will first be described with respect to a flow measurement system and then with respect to a volume measurement system.

The application of Equation (1) to the system defined within the dashed boundary outline 67 in FIG. 4 results in the following equation:

$$V_{ret}=(V_m+V_t)+\Delta V_{ts} \quad (3)$$

where $V_{ret}$ is the return mud volume flowing into the bottom of the telescoping section (corresponding to $V_{in}$ Equation (1)), $V_m$ is the volume flowing out of the system past the flow meter 45 and Vis the volume flowing out of the system into the surge tank 43. The sum $(V_m+V_t)$ corresponds to $V_{out}$ in Equation (1). The term $\Delta V_{ts}$ is the change in the volume of mud in the telescoping section and corresponds to $\Delta V_{sys}$ in Equation (1).

Figures 5A, 5B, 5C, 5D, 5E:
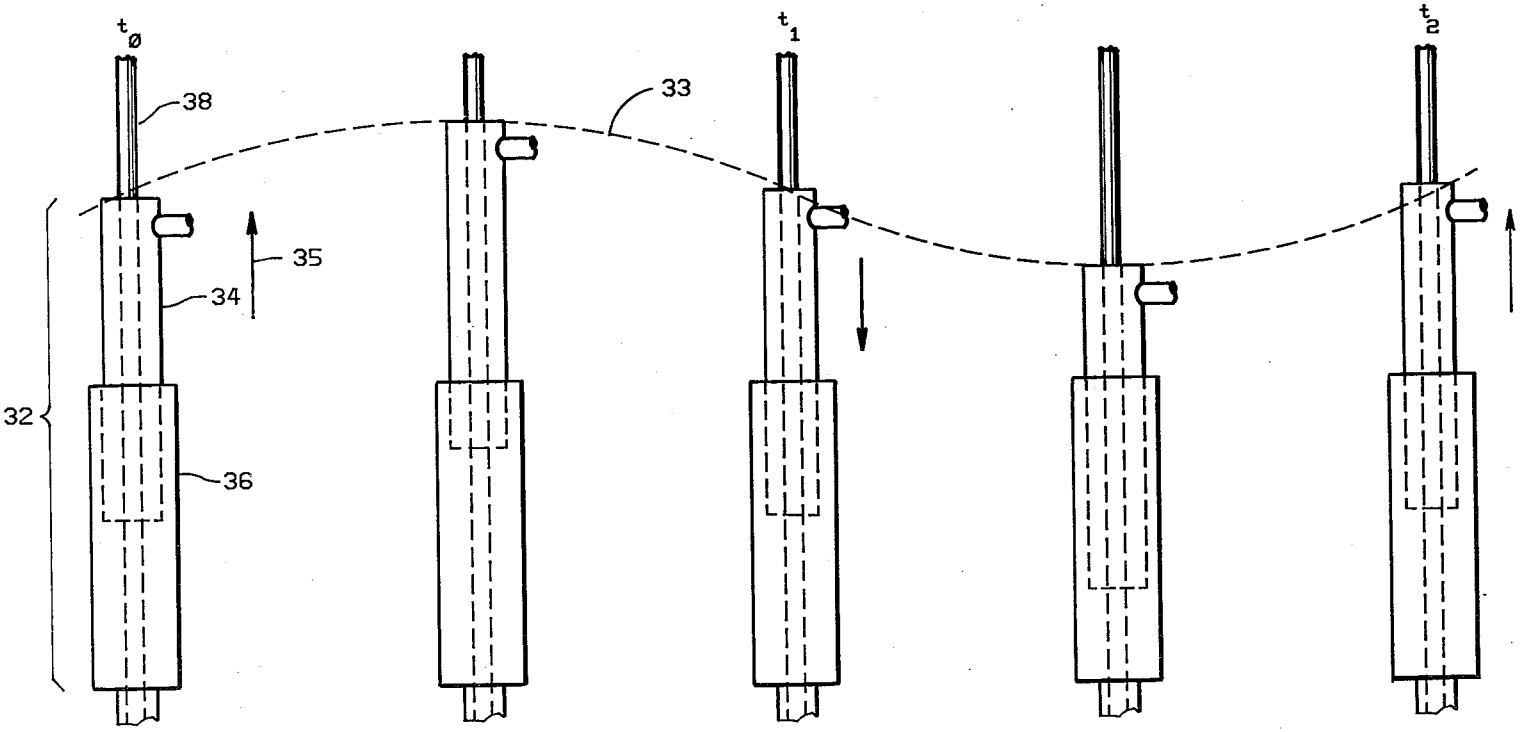
FIGS. 5A–5E illustrate sequential positions of the telescoping section during a heave cycle.

In order to appreciate the significance of the present invention, reference is made to FIGS. 5A through 5E which illustrate the sequential operation of the telescoping section. The dashed line 33 represents typical heave-induced motion of the upper cylinder 34 which is attached to the vessel. For purposes of discussion, FIG. 5A is referred to as the reference position. The reference position is chosen such that it is within the range of the stroking motion of the telescoping section, preferably near the mid-point of the cycle. At time $T_0$, represented by FIG. 5A, the telescoping section is in the reference position. The vessel is heaving upwardly, as represented by the arrow 35, thereby extending the telescoping section. FIG. 5B represents the relative orientation of the cylinders at a later point in time wherein the vessel is near the limit of its upward motion. Subsequently, the vessel heaves downward and at time $T_1$ the telescoping section is again in the reference position, represented by FIG. 5C. The vessel continues downward until, as represented by FIG. 5D, the motion reverses and the vessel begins to move upward again. At time $t_2$ (FIG. 5E) the telescoping section is in the reference position for the second time after $t_0$.

A suitable switch or similar contact means (not shown) is connected to the first and second cylinders such that each time the cylinders are in the reference position (e.g. times $t_0$, $t_1$ and $t_2$ in FIGS. 5A, C, and E) the switch or contact means is engaged emitting a signal. Thus, as the vessel heaves, signals are generated indicating those times at which the telescoping section is in the reference position. Typically, these signals will be generated at intervals ranging from about one to eight seconds.

At those times the upper and lower cylinders are in the reference position (hereafter occasionally referred to as "particular times"), the $\Delta V_{sys}$ term in Equation (3) will be zero. Therefore Equation (3) may be rewritten as:

$$V^*_{ret}=V^*_m+V^*_t \quad (4)$$

wherein the asterisk (*) symbol designates quantities determined over the intervals between the particular times (hereafter referred to as "particular time intervals" or "time periods"). Thus, one step in the method of the present invention is the determination of the particular times at which the volume of mud in the telescoping section is the same as in the reference position. By measuring the volumes $V^*_m$ and $V^*_t$ during the particular time interval between the particular times, the effect of the telescoping section volume can be neglected. This differs significantly from the prior art which requires that the volume of mud in the telescoping section be measured.

Equation (4) indicates that the desired quantity, $V^*_{ret}$, which is the volume of mud returning from the well, can be determined by measuring $V^*_m$ and $V^*_t$ and summing these quantities. These two volumes can be measured in numerous ways known to those skilled in the art, two of which will be explained in more detail later.

The rate of flow of drilling mud returning from the well is a very useful indicator of kicks or lost circulation. This quantity can also be conveniently computed by measuring the particular time intervals, represented by $\Delta t^*$. The average rate of return mud flow into the bottom of the telescoping section over a particular time interval, $Q^*_{ret}$, may be computed according to the following equation:

$$Q^*_{ret} = V^*_{ret}/\Delta t^* = V^*_m + V^*_t/\Delta t^* \quad (5)$$

Although $Q^*_{ret}$ is an average, the method of this invention differs substantially from other prior art methods which depend on averaging over preselected relatively long periods of time to reduce the observed magnitude of the heave-induced surges. These prior art methods inherently result in a decrease in the responsiveness of the flow measuring instrument to changes in the flow from the well. In the present invention the averaging periods are short and the compensation for heave complete; therefore, the instrument is extremely sensitive to changes in the return flow, with very little lag in its response.

The particular time intervals, $\Delta t^*$, referred to above need not be based on successive particular times. For example, referring to FIGS. 5A–5E, $\Delta t^*$ may be the intervals $t_0$ to $t_1$ and $t_1$ to $t_2$, or the single interval $t_0$ to $t_2$. In general, $\Delta t^*$ may be the interval between successive particular times or some multiple thereof.

The foregoing has explained the principles involved in applying the method of the present invention to compensate for vessel heave in instrument systems in which the return flow of drilling mud is determined to detect well control problems. The following paragraphs describe the application of the present invention to systems in which the volume of mud in tanks on the vessel is determined to detect well control problems.

As previously explained, the mud volumes contained in tanks in fluid communication with the well, e.g., the active mud tanks 48 of FIG. 4, are responsive to kicks and lost circulation. For purposes of this discussion, the volume in the tanks 48 (also known as "pits") will be represented by $V_p$. For an onshore well, $V_p$ is the only volume in the mud circulating system which varies significantly. However, in the configuration of FIG. 4, the volume of mud in the telescoping section, $V_{ts}$, the volume in the surge tank, $V_t$, and $V_p$ are all varying in response to vessel heave. Further, the volume $V_t$ is responsive to kicks and lost circulation in much the came manner as is $V_p$. In essence, the surge tank 43 can be considered an extension of the system of active mud tanks.

In practicing the present invention with a volume measurement system, it is necessary to measure the volumes $V_p$ and $V_t$ at the particular times previously defined. The volume $V_{ts}$ need not be measured since it is the same at each of the particular times and is not responsive to well conditions. Referring to Equations (1) and (3), this embodiment reduces to the following:

$$V^{} = V^{}_p + V^{**}_t \quad (6)$$

where the double asterisk () symbol denotes measurements made at the particular times and $V^{}$ is the desired volume indication, corrected for the effects of vessel heave.

A modification of the above method is possible when there is no circulation of the well and a sensitive volume measurement is desired. This can be used with either a flow or volume measurement instrument system as noted above. In this instance, the in-line valve 66 in FIG. 4 would be closed, isolating the flow meter 45 and the active mud tanks 48 from the well. The surge tank 43 would then to used as a trip tank. Since tanks 48 are isolated from the well and cannot respond to kicks or lost circulation, Equation (6) reduces to:

$$V^{} = V^{}_t \quad (7)$$

which indicates that the desired volume measurement is the volume measurement of the surge (or trip) tank at the particular times.

Figure 6:
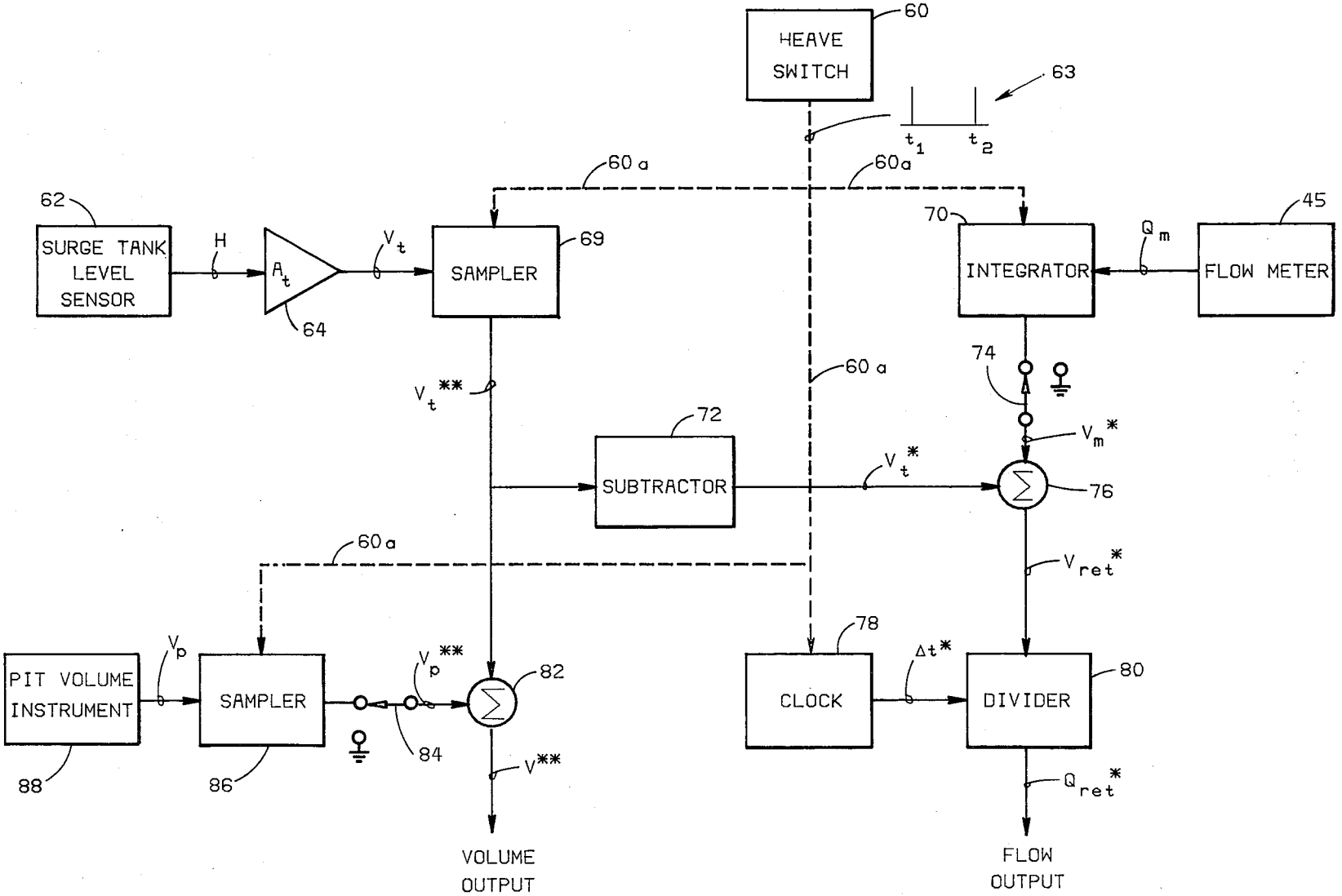
FIG. 6 is a block diagram of the present invention used to determine the flow rate and volume of drilling fluid flowing from a subaqueous well in a manner which is unaffected by the heave of the vessel.

A preferred apparatus for the practice of the present invention is shown diagrammatically in FIG. 6. The apparatus depicted is one capable of providing both volume and flow outputs, compensated for heave effects.

A heave switch 60 provides a signal at each particular time or multiple thereof that the telescoping section cylinders are in the reference position. A preferred apparatus for performing the functions of the heave switch 60 is described in greater detail later.

As indicated in FIG. 6, the output of the switch is a series of pulses, corresponding to the particular times. Two of these pulses occurring at particular times $t_1$ and $t_2$ are shown in the graph 63 of FIG. 6. These pulses are command signals and are transmitted via dashed lines 60*a* to an integrator 70, samplers 69 and 86, and counter 78.

The integrator 70 integrates the signal $Q_m$ from the flow meter 45 over the period between successive command signals (that is, from $t_1$ to $t_2$) and transmits that integrated value at $t_2$. This output is the quantity $V^*_m$ as previously defined. A further function of the integrator is to begin a subsequent integration at $t_2$ and continue until the next command signal. The output of integrator 70 preferably remains at the value obtained during the interval $t_1$ to $t_2$ until a subsequent integrated value is computed. In this manner, the output of integrator 70 will be the value of $V^*_m$ for the most recently complete particular time interval.

The design of integrator 70, using either analog or digital techniques, is well known to those skilled in the art. Its design depends in part on the type of flow meter 45 used. A preferred flow meter is the Model 10D1435A/U Magnetic Flow meter with two Model 50PZ1000A Flow Converters, manufactured by Fischer & Porter Company of Warminster, Pennsylvania. These components may be configured to produce a bidirectional flow meter, capable of measuring flow in either direction. With this configuration, two outputs are provided, one corresponding to the flow rate in one direction and the other corresponding to the flow rate in the reverse direction. These outputs each comprise a train of pulses, the frequencies of which are proportional to the rate of flow of mud through the magnetic flow meter in the respective direction. Therefore, each pulse corresponds to a specific volume of mud. With this type of flow meter, the integrator 70 is known as an "up-down counter" which totalizes the pulses received during the particular time interval. The counter will add those pulses (volumes) corresponding to flow out of the system and subtract those pulses (volumes) corresponding to reverse flow. In this manner, the integrator 70 produces an output indicative of the net volume of mud which has flowed out of the system past the flow meter, $V^*_m$.

The sampler 69 samples an input value at the particular times as indicated by the command signal and holds that value for output until it is replaced by a subsequent input value. Analog and digital samplers which perform this function are well known to those skilled in the art. As indicated in FIG. 6, the input to the sampler 69 is the volume of mud in the surge tank, $V_t$. As shown, this measurement is preferably obtained by measuring the level H of mud in the surge tank 43 using a level sensor 62 and scaling this measurement by the mud surface area, $A_t$, in the tank as indicated by an amplifier 64. A suitable device for performing both of these functions is the Universal Trip Tank Monitoring System, Series TTSX, manufactured by the Martin-Decker Company of Santa Ana, California as mentioned earlier.

The output of the sampler 69, therefore, corresponds to $V^{**}_t$, which is the volume in the surge tank 43 at the most recent particular time. This quantity is utilized in computing both volume and flow.

For flow determination, the output of the sampler is fed to the input of a subtractor 72 which subtracts the most recent value of $V^{**}_t$ from that corresponding value measured at the immediately preceding particular time. The output, therefore, is the value $V^*_t$ which represents the net increase in the volume of mud in the surge tank 43 over the most recently completed particular time interval. It can be seen by reference to FIG. 4 that this also is the net volume of mud flowing out of the system defined by the dashed line 67 into the surge tank 43. Of course, decreases in the volume of the surge tank would be represented by negative values of $V^*_t$.

As shown in FIG. 6, the output of the integrator 70 ($V^*_m$) and the subtractor 72 ($V^*_t$) are added at a summing point 76. As indicated by Equation (4), this sum is $V^*_{ret}$ which is the volume entering the bottom of the telescoping section over the most recently completed particular time interval.

A third device receiving the command signal from the switch 60 is the clock 78 which determines the period of time, $\Delta t^*$, corresponding to the most recently completed particular time interval. These devices are well known to those skilled in the art.

A divider 80 is connected to the summing point 76, the divider receives the $V^*_{ret}$ signal from the point 76 and divides it by the corresponding particular time interval, $\Delta t^*$. As demonstrated by Equation (5), this computation results in the desired flow rate $Q^*_{ret}$, unaffected by vessel heave.

For volume determination, the output $V^{}_t$ of the sampler 69 is added to the sampled volume $V^{}_p$ from the active mud tanks. This latter quantity is preferably determined by a pit volume instrument 88 such as the Mud Volume Totalizer, Series MVTX, manufactured by the Martin-Decker Company of Santa Ana, California as mentioned earlier. The output, $V_p$, of the pit volume instrument 88 is fed to the second sampler 86. The operation of this device is controlled by the command signal from the heave switch 60 and is similar in structure and operation to the sampler 69 previously described. The $V^{}_p$ output is then added to the $V^{}_t$ output at the summing point 82. The resulting value is $V^{**}$ in accordance with Equation (6).

The apparatus of FIG. 6 contains two switches 74 and 84. Both are operated in conjunction with the valve 66 in FIG. 4. They are shown in their normal position, corresponding to the open position of the valve 66. When the valve 66 is closed, these switches go to the zero input position (represented by the ground symbol in FIG. 6). This is the electrical analog of closing the valve and permits the sensor 62 to monitor volumes and flows into the surge tank 43 alone. This mode corresponds to the "tripping" operation described earlier.

It will be evident from the foregoing that heave switch 60 performs a most critical function in the present invention. The switch means may be a standard toggle switch mounted to the second cylinder which is struck by a striker (not shown) mounted to the first cylinder each time the cylinders are in the reference position. Such a switch means is readily constructed by one skilled in the art. Alternatively, the switch may be mounted to the riser tensioners 30 (see FIG. 1) rather than the telescoping section since relative movement of the tensioner with respect to the vessel is similar in phase to the movement of the first cylinder with respect to the second cylinder.

Figure 7:
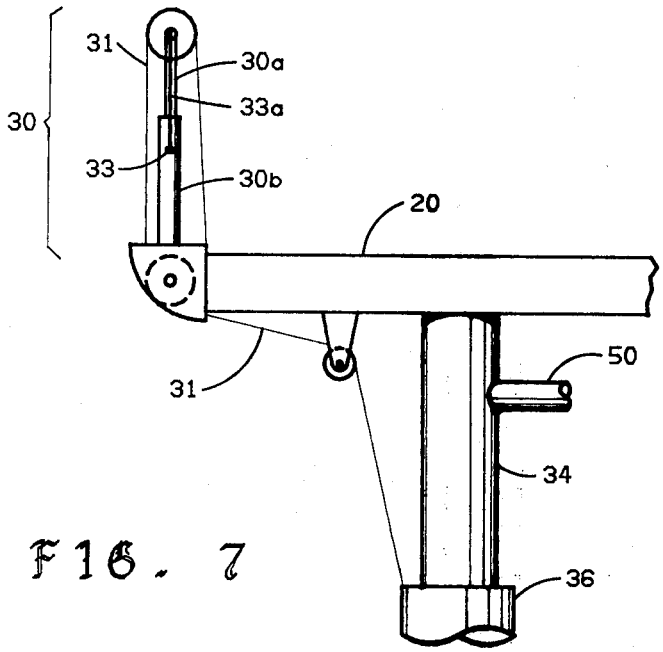
FIG. 7 is a detail of a riser tensioner having a potentiometer mounted thereto to sense the relative location of the upper and lower cylinders of the telescoping section.

Rather than a toggle arrangement, the switch means may include a cable-pull potentiometer. Such a potentiometer is well known in the art and available from, for example, Humphrey, Inc. of San Diego, California. As illustrated in FIG. 7, the tensioner 30 is attached to the lower cylinder 36 by a cable 31. The lower cylinder 36 is suspended from the vessel 20 by the tensioner 30 yet the cylinder 36 remains stationary due to the compensating function of the tensioner 30. The tensioner 30 includes reciprocating cylinders 30*a*, 30*b* which coincide with the reciprocating movement of the upper and lower cylinders 34, 36. The cable-pull potentiometer 33 measures a voltage variation stemming from the relative extension of a cable 33*a*, attached to the cylinder 30*a*, with respect to the potentiometer, attached to the cylinder 30*b*.

Figure 8:
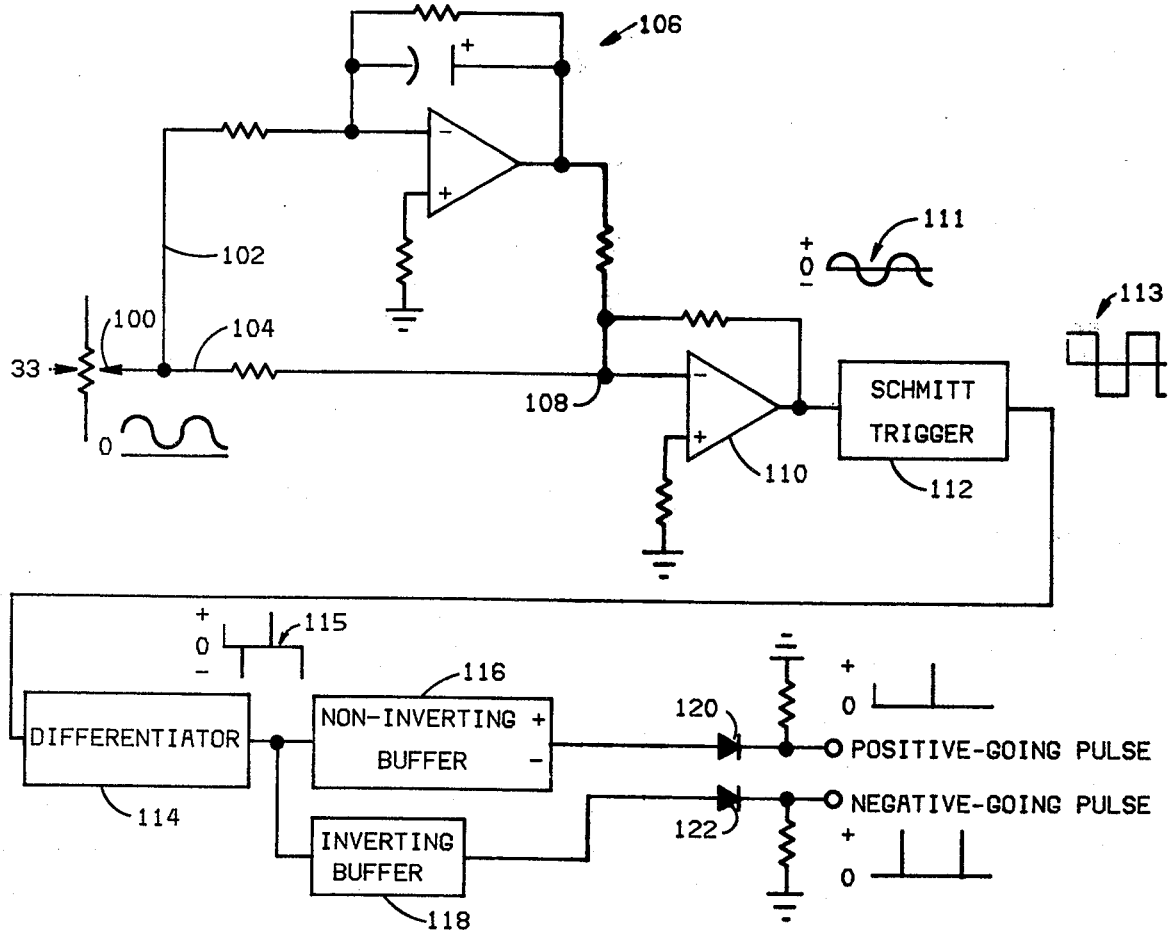
FIG. 8 is an electrical schematic of a switch means, employing the potentiometer to monitor the relative location of the upper and lower cylinders of the telescoping section and control the processing of information by the invention.

The electrical schematic of a switch means 60 is illustrated in FIG. 8. The cable-pull potentiometer 33 generates an output voltage which is an analog of the extension of the telescoping section. While it may appear in the first instance that a signal proportional to the length of the telescoping section is being generated, it will become apparent that the analog voltage output is used merely to eliminate the influence of tidal fluctuation and generate command signals at the desired particular times.

Referring to FIG. 8, the output voltage from an wiper element 100 of the potentiometer 33 is split into two branches 102, 104. The first branch 102 connects with an integrating circuit 106. The circuit 106 serves as a low-pass filter. In other words, the circuit 106 filters out all wave movement except very low frequency movement, e.g. periods of over five minutes. This filtered signal represents the reference position of the telescoping section. The filtered signal from the circuit 106 is inverted and summed at junction 108 with the original signal passing along the branch 104. The summed voltage is then passed through an amplifier 110. In this manner, the filtered signal from the circuit 106, when inverted and summed with the potentiometer output voltage, reduces the voltage to fluctuation about a modified zero voltage level (curve 111, FIG. 8) which negates the tidal influence by adjusting the zero level. This eliminates having to physically relocate the switch on the tensioner or the telescoping section. Thus, the circuit automatically adjusts for such long-term variations as tidal fluctuations. This is a principal advantage of the potentiometer over the mechanical toggle switch as discussed above. Since substantial tidal variation may relocate the natural zero line of oscillation of the upper and lower cylinders 34, 36, contact between the striker and contact might not occur without relocating the mechanical switch.

The output signal from the amplifier 110 is fed into a Schmitt trigger 112 whose output is a square-wave signal (curve 113) having the same zero crossings and polarity as the input signal (curve 111). The square-wave signal is then fed into a differentiator circuit 114 which converts the square-wave signal from the trigger 112 into a series of pulses (curve 115) occurring at each zero crossing of the wave signal. The polarity of each pulse depends on whether the zero crossing was positive-going or negative-going. The output pulse from the differentiator 114 is fed into a non-inverting buffer 116 and an inverting buffer 118. The output of the non-inverting buffer is fed to a diode 120 which passes only positive-polarity pulses. These pulses would correspond, for example, to crossings of the reference position of the telescoping section as it is extending (i.e., positive-going crossings). The output of the inverting buffer 118 is fed to a similarly oriented diode 122 which passes only positive pulses. However, because of the voltage inversion, these pulses correspond to negative-going crossings of the reference position (contraction of the telescoping section).

The heave switch of FIG. 8 has two outputs, one corresponding to positive-going crossings of the telescoping section reference position and one corresponding to negative-going crossings. Either one may be used for the command signal in FIG. 6. Alternatively, these two outputs may be summed and the resultant used as the command signal. In this event, a command signal would be generated at each crossing of the reference position, regardless of the direction of motion.

Referring back to FIGS. 5A–5E, a first signal or pulse is generated at the positive-going output when the cylinders are momentarily in the predetermined position as shown in FIG. 5A and the telescoping section is extending. As the vessel rises due to the crest of an ocean wave, the first cylinder advances upward with respect to the second cylinder as illustrated in FIG. 5B. The vessel is then lowered into the trough of the wave as it passes resulting in the descent of the first cylinder with respect to the second cylinder. At the time represented by FIG. 5C a signal is generated at the negative-going output indicating that the telescoping section is once again in the reference position and is contracting. Thus, while a voltage from the potentiometer 33 is varying proportionate to the length of the telescoping section, the output signals are indicative of only the relative position of the cylinders with respect to the reference position.

Based on the foregoing disclosure, the usefulness of the present invention with the piping configuration represented by FIG. 4 is apparent since the only assumption involved is that of incompressibility of the drilling mud. Provided the mud does not have significant quantities of entrained air or gas, this is a reasonable assumption. There are, however, alternate piping configurations with which the present invention may be used.

FIG. 9 is another configuration with which the present invention may be used. It is similar to that of FIG. 4 except the rotating seal 58 has been removed. Rotating seals may incur frictional damage due to the heave-induced motion of the seal relative to the drill string 38. Consequently, this component may require frequent maintenance and its use may not be desirable. To prevent mud from spilling out the open top end of the marine riser 26, the shale shaker 46, surge tank 43 and conduit 50 have been lowered in FIG. 9 relative to their location in FIG. 4. The elevations of these components relative to the outlet 27 of marine riser 26 are chosen such that conduit 50 remains full of mud. Although the principles involved in the design of these components are known, it is recognized that constraints imposed by the overall design of the drilling vessel may prevent achieving this objective under all conditions of heave, mud flow and mud rheological properties. It is anticipated, however, that the conduit 50 will remain full of mud under most conditions.

The effect of the modifications illustrated in FIG. 9 creates an additional free mud surface 59 in the upper part of the marine riser 26. Obviously, if the level of this mud surface can be measured, it could be treated as an additional surge tank according to the principles disclosed above. However, under most conditions this will not be necessary. The area of the free mud surface 59 in the marine riser (hereafter designated ($A_r$) is usually small compared with the area $A_t$ of the free surface in the surge tank. Consequently, errors in determining $V^*_{ret}$ are not anticipated to be large, even if free surface 59 were neglected. However, recognizing that the level variations of the free surface 59 will be similar in magnitude an phase to those of the free surface 68 in surge tank 43, a further improvement may be made by considering the measurement of the surge tank level "H" (see FIG. 9) to be also a measurement of the mud level in the marine riser. In the apparatus of FIG. 6, this could be accomplished simply by increasing the gain of the amplifier 64 from $A_t$ to $(A_t+A_r)$.

Another piping configuration with which the present invention may be employed as illustrated in FIG. 3. In this configuration, the conduit 50 and the upper part of the marine riser 26 are generally not full of mud, even under normal conditions. As stated above, the complexity of this geometry makes it impractical to measure the volume of mud within these components. However, by practicing this invention, the largest component of error—the telescoping section volume—is eliminated. For this application, the apparatus of FIG. 6 may be used by removing the level sensor 62, amplifier 64, sampler 69 and subtractor 72, which are all associated with surge tank volume measurements.

As noted above, it is well known in the art to detect well control problems by comparing the rate of flow of drilling mud returning from the well ($Q^*_{ret}$ in the present invention) with either (i) the rate of return mud flow at earlier times or (ii) the rate of circulating mud into the well. The former comparison may be accomplished in numerous ways with the present invention, preferably by either recording the output $Q^*_{ret}$ on a chart recorder or by setting alarms which are activated whenever $Q^*_{ret}$ deviates by more than a predetermined amount from a value determined during earlier trouble-free operations. The latter comparison can be made in numerous ways well known to those skilled in the art, two of which are illustrated below.

Figure 11:
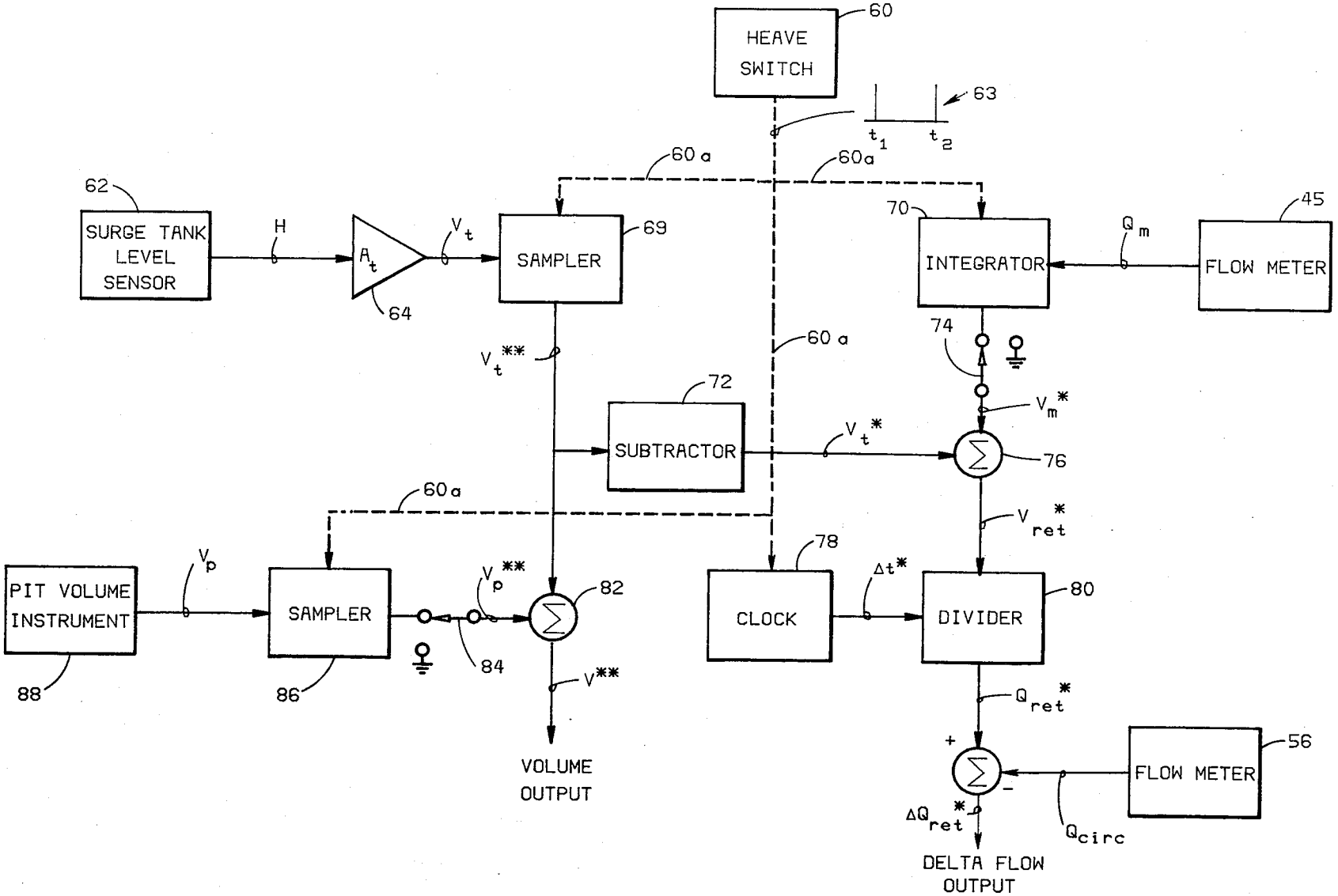
FIG. 11 is a block diagram of the present invention used to determine the presence of a kick or lost circulation in a subaqueous well.

FIG. 11 depicts a modification of the apparatus of FIG. 6 in which the rate of flow of mud circulating into the well, $Q_{circ}$, is substracted from the return mud flow rate $Q^*_{ret}$ to yield a delta flow parameter, $\Delta Q^*_{ret}$. Mathematically, this corresponds to the equation:

$$\Delta Q^*_{ret} = Q^*_{ret} - Q_{circ} \quad (8)$$

The signal $Q_{circ}$ is obtained from the flow meter 56, illustrated in FIG. 1.

Figure 12:
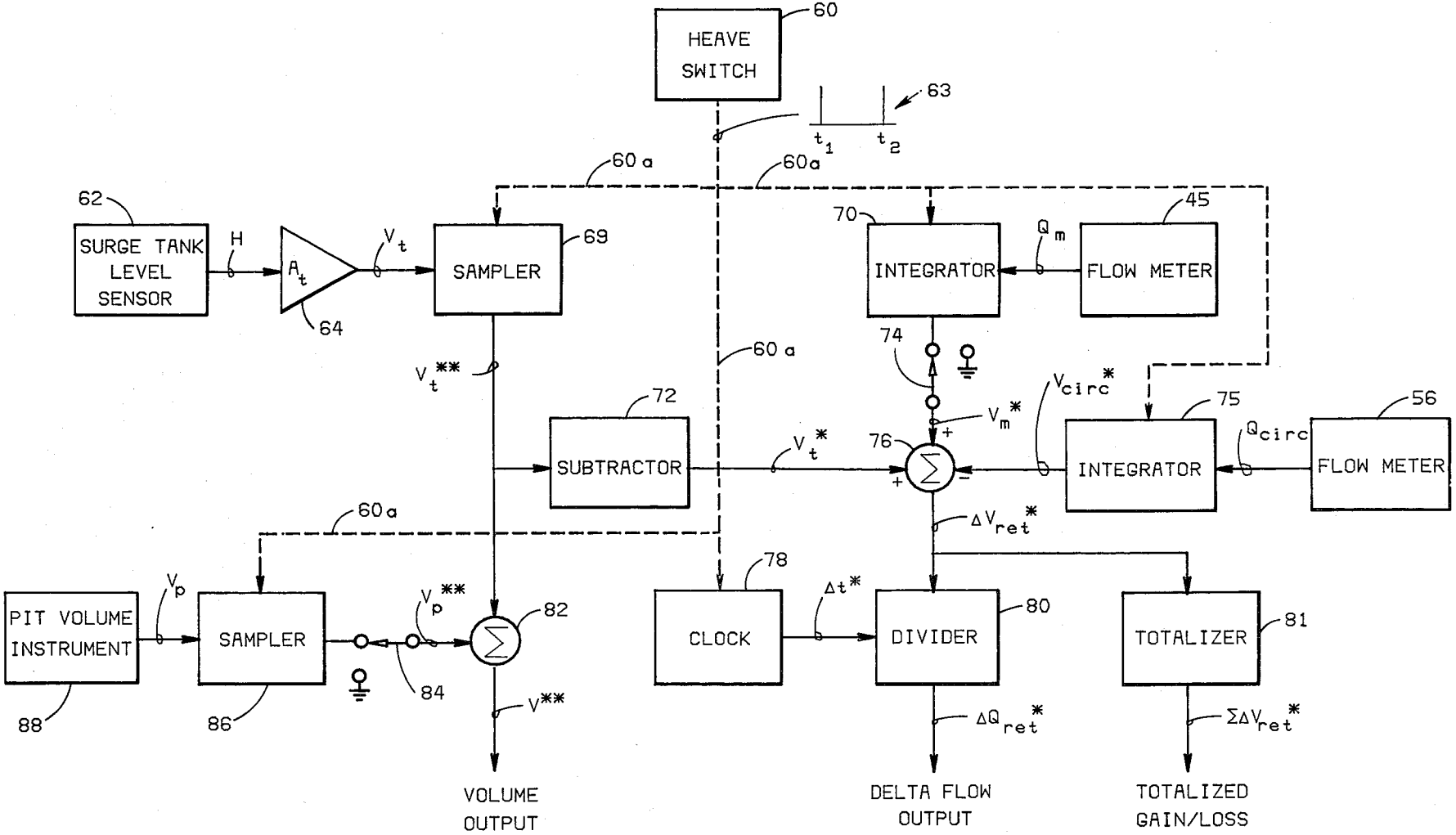
FIG. 12 is a block diagram of an alternate embodiment of the present invention used to determine the presence of a kick or lost circulation in a subaqueous well.

An alternate approach for comparison of the flow rates is depicted in FIG. 12. The output of the flow meter 56 is fed to an integrator 75 which functions similarly to the integrator 70. The integrator 75 integrates the signal $Q_{circ}$ over the period between successive command signals (that is, from $t_1$ to $t_2$) and transmits that integrated value as output at $t_2$. The output is the quantity $V^*_{circ}$ which is the volume of mud pumped into the drill string 38 during the particular time interval. This integrated output is then subtracted from the sum of $V^*_t$ and $V^*_m$ at summing point 76 to form the quantity $\Delta V^*_{ret}$. Mathematically, this is expressed as:

$$\Delta V^*_{ret} = V^*_m + V^*_t - V^*_{circ} \quad (9)$$

where $\Delta V^*_{ret}$ is the difference between the volume of drilling mud which has entered the bottom of the telescoping section over the particular interval and the volume of mud pumped into the drill string 38 from the tanks 48 over the same interval. A positive value of $\Delta V^*_{ret}$ is indicative of a kick while a negative value is indicative of lost returns.

The signal $\Delta V^*_{ret}$ may be processed in several ways. For example, it may be fed into the divider 80 as shown in FIG. 12 to produce the delta flow parameter $\Delta Q^*_{ret}$, expressed as:

$$\Delta Q^*_{ret} = V^*_m + V^*_t - V^*_{circ} / \Delta t^* \quad (10)$$

Equation (10) is analagous to Equation (5). However, Equation (10) concerns the determination of a difference, delta flow. Alternatively, the $\Delta V^*_{ret}$ values may be fed into a totalizer 81 which adds each successive $\Delta V^*_{ret}$ to the total of previous values. Totalizers are well known in the art. In this manner, the net volumetric gain or loss of mud from the well, $\Sigma\Delta V^*_{ret}$, is determined. This quantity is similar to the change in the volume $V^{}$ of mud in the surface mud system but is unaffected by additions or deletions of materials from the active mud tanks 48. In the preferred embodiment, the totalizer 81** would be activated whenever the parameter $\Delta Q^*_{ret}$ exceeded preset limits indicative of a well control problem. The output $\Sigma\Delta V^*_{ret}$ would then indicate the total gain or loss from the well from the inception of the problem. This information is very useful in planning well control procedures.

DESIGN EXAMPLE

Figure 10:
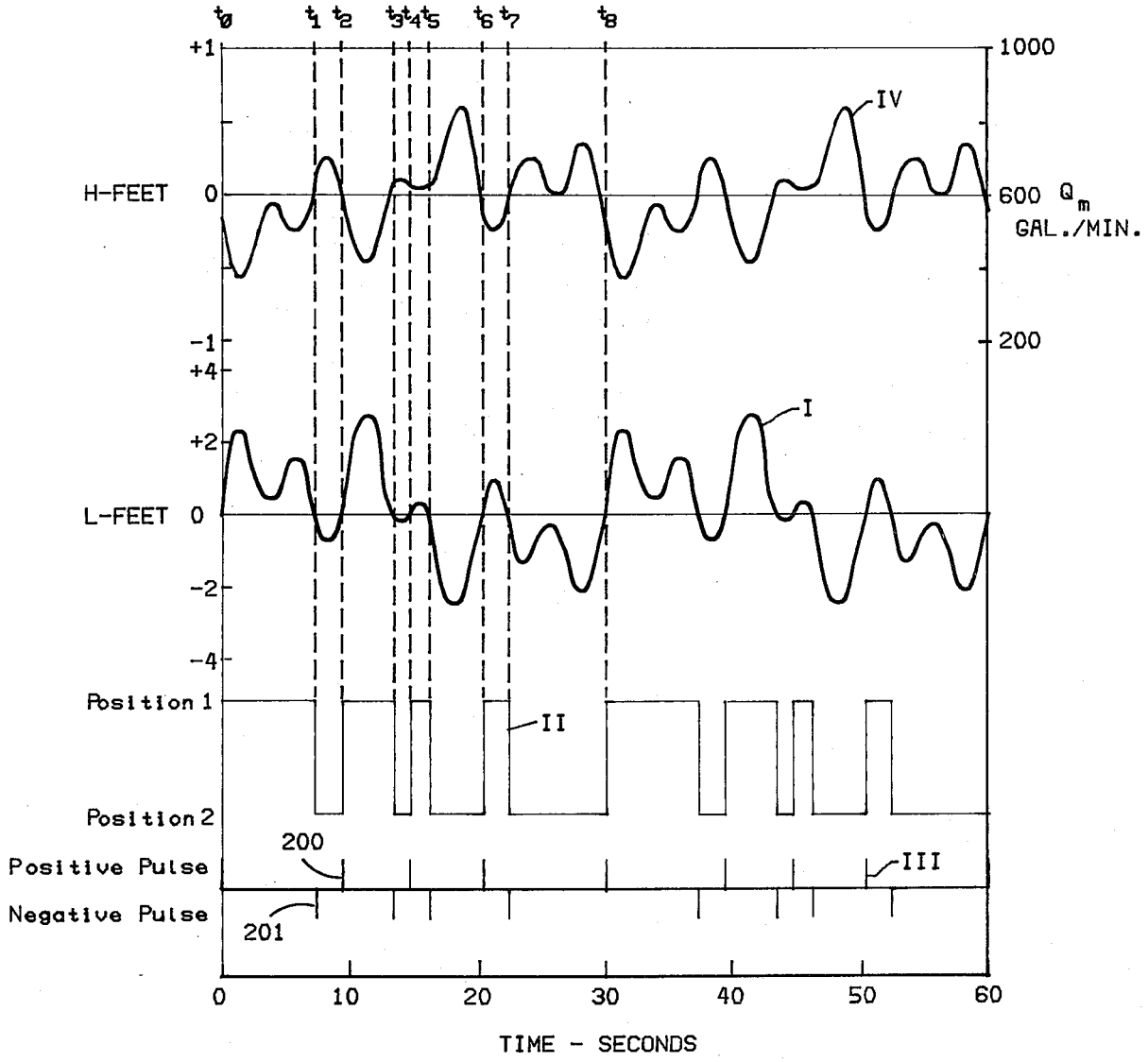
FIG. 10 is a graph illustrating change in the length of the telescoping section and several other parameters as a function of time resulting from vessel heave.

FIG. 10 is a graphical representation of data generated from the embodiment of the invention disclosed in FIG. 6, and employed with a configuration as illustrated in FIG. 4. The curves in FIG. 10 are based on an upper cylinder 34 with an outer diameter of 18-$\frac{5}{8}$ inches, a drill string 38 with an outer diameter of 5 inches and a surge tank 43 with a crosssectional area of approximately 7.08 square feet.

Curve I illustrates the change in length of the telescoping section as a function of time. The adjusted zero axis represents the reference position of the telescoping section.

Curve II is a squared curve illustrating the position of a mechanical switch or the output 113 of the Schmitt trigger 112 in FIG. 8 as a function of time. For example, starting at time $t_0$ the telescoping section is in the reference position as indicated by the location of Curve I at the zero axis. This position corresponds with FIG. 5A. As the upper cylinder advances upwardly the switch assumes Position 1 when the upper cylinder departs from the reference position. The switch remains in Position 1 until the telescoping section returns to the reference position at time $t_1$ at which point the switch position changes to Position 2. The upper cylinder then continues downwardly, reaches a minimum elevation, and then reverses its motion with respect to the lower cylinder as illustrated in Curve I until time $t_2$ when the telescoping joint is again at the reference position. Therefore, during all positive or upward displacements of the upper cylinder with respect to the reference position, the switch is maintained in Position 1. Similarly, all negative or downwardly displacements of the upper cylinder with respect to the reference position maintains the switch in Position 2. Obviously, Position 1 and Position 2 can be represented by different voltage levels in an electronic circuit.

Curve III is a pulse train obtained by differentiating Curve II. Curve III illustrates the generation of a positive pulse 200 each time the first cylinder is advancing upwardly and crosses the reference position. A negative pulse 201 is generated each time the first cylinder is advancing downwardly and crosses the reference position. The use of these positive and negative pulses in generating command signals is explained above with respect to FIG. 8.

A linear head-flow relationship was assumed in computing the hydraulic behavior of this system as a function of time. Consequently, Curve IV represents the behavior of two parameters. As shown by the label of the left-hand ordinate, the graph indicates the variation in the level H of the mud in the surge tank about a mean level, arbitrarily assigned the value of zero. Because this level (or head) supplies the driving force for flow through the flow meter, Curve IV also represents the variation in this flow, $Q_m$. The right-hand ordinate indicates the magnitude of these variations about a mean flow rate of 600 gal/min which is the assumed flow into the bottom of the telescopting section. During the expansion of the telescoping section between $t_0$ and $t_1$ or $t_2$ and $t_3$, the volume of fluid in the surge tank and the flow rate through the flow meter decrease, as indicated by the values of H and $Q_m$ between $t_0$ and $t_1$ or $t_2$ and $t_3$. Tank level and flow rate increase during intervals of telescoping section contraction such as between $t_1$ and $t_2$ and $t_5$ and $t_6$.

Referring to Table 1 for a more detailed tabulation of data from the Design Example, the computed height at each of the particular times ($t_0$, $t_1$, etc.) is indicated along with the computed volume of fluid having passed the flow meter downstream the surge tank during the preceeding particular time interval.

Knowing the mud level $H^{**}$ in the surge tank at each particular time and the volume passing the flow meter $V^*_m$ during each particular interval, the flow rate of mud into the bottom of the telescoping section can be determined as follows:

Between $t_0$ and $t_1$:

$$\Delta H^* = H_1 - H_0 = +0.0671 - (-0.1691) = +0.2362 \text{ ft}$$

$$\Delta V^*_t = 0.2362 \text{ ft.} \times 7.08 \text{ sq ft} \times 7.48 \text{ Gal/cu ft} = 12.52 \text{ gal}$$

$$V^*_{ret} = 12.52 \text{ gal} + 62.48 \text{ gal} = 75.00 \text{ gal}$$

$Q^*_{out}$=(75 gal/7.5 sec)×(60 sec/min)=600 gal/min

Performing the above calculations for each particular time interval yields a constant flow rate of 600 gallons per minute which is the flow rate into the bottom of the telescoping section.

As noted above, the invention is not limited to the comparison of immediately adjacent intervals. Rather, one may practice the invention by skipping every other time interval of some multiple thereof. Alternatively, one may practice the invention by combining two or more intervals and redefining them as one interval. Or, one may define a time interval between "like-sign zero crossings" by using only the positive or negative pulses of Curve III. In other words, at time $t_0$ the slope of Curve I is positive since it is increasing. At time $t_1$ the slope of Curve I is negative since it is decreasing. However, at time $t_2$ the slope of the line is once again increasing and, therefore, positive. A reading taken between $t_0$ and $t_2$, termed "positive zero crossings", will yield the flow rate when the respective mud elevations in the surge tank along with the combined volume flow through the meter $V^*_m$ between $t_0$ to $t_2$ is considered. Performing such a calculation yields a flow rate of, once again, 600 gallons per minute.

Table 2 summarizes the specific values based on intervals between "positive zero crossings" (positive pulses). The data from which this table was generated are the same as for Table 1. It can be seen that the volumes $V^*_{ret}$ and the times $\Delta t^*$ are both larger in Table II than in Table I. From the standpoint of minimizing errors it is good practice to make the time intervals as large as possible, consistent with maintaining adequate speed of response in the instrument. It has been found that values of $\Delta t^*$ of approximately 30 seconds represent a preferred time frame. If the average heave period of the vessel were about eight seconds, an interval consisting of eight consecutive reference crossings (or four consecutive like-sign zero crossings) would be desirable. In the Design Example, this interval would be from $t_0$ to $t_8$.

The foregoing invention has been described in terms of various embodiments. Obviously, many modifications and alterations based on the above disclosure will be apparent to those skilled in the art. It is, therefore, intended to cover all such equivalent modifications and variations which fall within the scope of this invention.

What is claimed is:

1. A method for determining the flow of a drilling fluid during a floating drilling operation having a marine riser and a telescoping section, said method comprising:

determining a reference position on the telescoping section; and measuring the volume of drilling fluid flowing from said telescoping section during the time period in which said telescoping section moves away from and back to the reference position.

2. The method according to claim 1 wherein said method includes determination of the flow rate of drilling fluid flowing from said telescoping section into said riser, said method further comprising:

measuring the length of time during said time period; and determining the flow rate of drilling fluid flowing from said telescoping section into said riser by dividing said measured volume of drilling fluid by said length of time of said time period.

3. A method for detecting an abnormal drilling condition in a floating drilling operation having a marine riser, a telescoping section, a drill string extending through said riser and telescoping section, and means for pumping drilling fluid down through said drill string and up through said riser and telescoping section, said method comprising:

(a) determining a reference position on the telescoping section;

(b) measuring the volume of drilling fluid flowing from said telescoping section during the time period in which said telescoping section moves away from and back to the reference position;

(c) measuring the volume of drilling fluid pumped into said drill string during said time period; and (d) comparing the volume measured in step (b) with the volume measured in step (c), a difference between the two indicating an abnormal drilling condition.

4. A method for determining the flow rate of drilling fluid flowing from an offshore well into a marine riser wherein said well is being drilled from a floating vessel wherein said marine riser connects said vessel with said well, and a mud system in communication with said riser by means of a conduit circulates said drilling fluid within said well and riser wherein said marine riser includes a telescoping section, having an upper and lower cylinder, to accommodate vertical or heave movement of said vessel, said method comprising the steps of:

sensing the relative position of said upper and lower cylinders with respect to a predetermined relative position of said cylinders wherein a first signal is generated when said cylinders vary from said predetermined position initiating a clock, and a second signal is subsequently generated when said cylinders return to said predetermined position terminating said clock and defining a time period between said first and second signals;

measuring the volume of said drilling fluid flowing downstream said telescoping section during said time period; and determining the flow rate of drilling fluid flowing from said well into said riser by dividing said measured volume of drilling fluid flowing downstream said telescoping section by said time period.

5. The method according the claim 4 wherein said conduit is maintained continuously full of drilling fluid, said method comprising the further step of defining successive time periods by generating successive signals and measuring a volume of drilling fluid flowing downstream said telescoping section within each time period thereby permitting the determination of multiple flow rates.

6. A method for determining a kick or loss of circulation in an offshore well being drilled from a floating vessel wherein a marine riser connects said vessel with said well, and a mud system in communication with said riser circulates a drilling fluid within said riser, said riser includes a telescoping section, having an upper and lower cylinder, to accommodate vertical or heave movement of said vessel, said method comprising the steps of:

sensing the relative position of said upper and lower cylinders with respect to a predetermined relative position of said cylinders wherein a first signal is generated when said cylinders vary from said predetermined position and a second signal is subsequently generated when said cylinders return to said predetermined position;

measuring the volume of drilling fluid entering said well from said mud system between said first and second signals;

measuring the volume of drilling fluid flowing downstream said telescoping section between said first and second signals; and determining a kick or loss of circulation in said well when said measured volume of drilling fluid entering said well from said mud system is not substantially equal to said measured volume of drilling fluid flowing downstream said telescoping section.

7. The method according to claim 6, said method comprising the further steps of generating successive signals and measuring a volume of drilling fluid entering said well from said mud system and a volume of drilling fluid flowing downstream said telescoping section between successive signals permitting the determination of multiple differences between the measured volume of drilling fluid entering said well from said mud system and the measured volume of drilling fluid flowing downstream said telescoping section.

8. A method for determining the flow rate of drilling fluid flowing from an offshore well being drilled from a floating vessel wherein a marine riser, having a telescoping section with an upper and a lower cylinder, connects said vessel with a well, and a mud system, having a surge means, in communication with said riser circulates a drilling fluid in said well and riser, said method comprising the steps of:

sensing the relative position of said upper and lower cylinders with respect to a predetermined relative position of said cylinders wherein a first signal is generated when said cylinders vary from said predetermined position initiating a clock, and a second signal is subsequently generated when said cylinders return to said predetermined position terminating said clock and defining a time period between said first and second signals;

measuring the volume of drilling fluid in said surge means when the clock is initiated;

measuring the volume of drilling fluid in said surge means when the clock is stopped;

calculating the change in volume of drilling fluid in the surge means;

measuring the volume of drilling fluid flowing downstream said surge means during the time period; and determining the flow rate of said drilling fluid flowing from said well into said riser by dividing the sum of the measured volume of drilling fluid flowing downstream said surge means and the measured change in volume of drilling fluid in the surge means by the length of time between the first and second signals.

9. The method according to claim 8 wherein said conduit is maintained continuously full of drilling fluid, said method comprising the further step of defining successive time periods by generating successive signals and measuring a volume of drilling fluid flowing downstream said surge means within each time period permitting the determination of multiple flow rates.

10. A method for determining an abnormal drilling condition in an offshore well being drilled by a floating vessel having a marine riser which extends from said well to said vessel and a mud system, having a surge means and in communication with said riser by means of a conduit which extends from said mud system to said riser, said mud system circulates a drilling fluid within said well and riser wherein said conduit is continuously full of drilling fluid and said riser includes a telescoping section, having an upper and lower cylinder, to accommodate vertical or heave movement of said vessel, said method comprises the steps of:

sensing the relative position of said upper and lower cylinders with respect to a predetermined relative position of said cylinders wherein a first signal is generated when said cylinders vary from said predetermined position, and a second signal is subsequently generated when said cylinders return to said predetermined position;

measuring the volume of drilling fluid entering said well from said mud system between said first and second signals;

measuring the volume of drilling fluid in said surge means when the first signal is generated;

measuring the volume of drilling fluid in said surge means when the second signal is generated;

calculating the change in volume of drilling fluid in the surge means;

measuring the volume of drilling fluid flowing downstream said surge means between said first and second signals; and determining an abnormal drilling condition in a well when the sum of said measured volume of drilling fluid flowing downstream from said surge means and said measured change in the volume of drilling fluid in said surge means is not substantially equal to said measured volume of drilling fluid entering said well from said mud system.

11. The method according to claim 10 wherein said method further comprises the steps of generating successive signals and measuring a volume of drilling fluid entering said well from said mud system and a volume of drilling fluid flowing downstream said telescoping section between successive signals permitting the determination of multiple differences between the measured volume of drilling fluid entering said well from said mud system and the measured volume of drilling fluid flowing downstream said telescoping section.

12. In a system for offshore drilling from a floating vessel having a marine riser which extends from the well to the vessel and a mud system which is connected with said riser by means of a conduit wherein said mud system circulates drilling fluid through said well and riser, said riser includes a telescoping section having an upper and lower cylinder to accommodate vertical or heave movement of said vessel, the improved apparatus for determining a flow rate of drilling fluid flowing into said riser from said well comprises:

means for sensing the relative position of said upper and lower cylinders with respect to a predetermined relative position capable of emitting signals when said cylinders are momentarily in said predetermined postion;

means measuring time between successive signals defining a series of successive time periods; and first means for measuring the volume of drilling fluid flowing downstream said telescoping section during any of said time periods permitting the determination of the flow rate of drilling fluid flowing from said well when the volume measured within a particular time period is divided by that time period.

13. The improved apparatus according to claim 12 wherein said sensing means comprises a switch means to monitor said cylinders and emit said signals.

14. The improved apparatus according to claim 13 wherein said switch means comprises:

a potentiometer to monitor the relative movement of said cylinders and generate a voltage varying as a function of said relative movement;

a filter means connected to said potentiometer to eliminate all voltage variations above a predetermined frequency permitting all filtered voltage variations below said predetermined frequency to pass;

means for determining the difference between said filtered voltage variations and said generated voltage variation of said potentiometer to define a modified zero axis about which said voltage varies wherein said modified zero axis is representative of said predetermined position; and means for converting said varying voltage into discrete signals when said voltage crosses said zero axis thus providing for a signal when said cylinders are in said predetermined position.

15. The apparatus according to claim 12 further comprising:

second means for measuring the volume of drilling fluid entering said well from said mud system during each of said time periods; and means for determining a difference between the measured volumes of said first and second means during identical time periods wherein a difference indicates the presence of an abnormal drilling condition.

16. In a system for offshore drilling from a floating vessel having a marine riser which extends from the well to the vessel, and a mud system which connects with said riser by means of a conduit wherein said mud system circulates drilling fluid through said well and riser and wherein said riser includes a telescoping section having an upper and lower cylinder to accommodate vertical or heave movement of said vessel and said mud system includes a surge means to attenuate a sudden change in volumetric displacement of drilling fluid within said telescoping section, the improved apparatus for determining a kick or loss of circulation from said well comprises:

means for sensing the relative position of said upper and lower cylinders with respect to a predetermined relative position capable of emitting signals when said cylinders are momentarily in said predetermined position;

means for measuring the time between successive signals defining a series of successive time periods;

first means for measuring the volume of drilling fluid flowing downstream said surge means during any of said successive time periods;

second means for measuring the volume of drilling fluid entering said well from said mud system during any of said successive time periods; and third means for measuring a change in the volume of the drilling fluid within said surge means during each of said succesive time periods permitting the determination of the presence of either a kick or loss of circulation of well when the summation of the volume measured by said first means and the measured change in volume measured by said third means during identical time periods is not substantially equal to the volume measured by said second means during the same time period.

17. In a system for offshore drilling from a floating vessel having a marine riser which extends from the well to the vessel and a mud system which is connected with said riser by means of a conduit wherein said mud system is capable of circulating drilling fluid through said well and riser, and wherein said riser includes a telescoping section having an upper and lower cylinder to accommodate vertical or heave movement of said vessel and said mud system includes a tank means which contains drilling fluid in communication with said conduit, during a non-circulating drilling fluid mode, the improved apparatus for determining a kick or drilling fluid loss comprising:

means for sensing the relative position of said upper and lower cylinder with respect to a predetermined reference position wherein said sensing means emits a signal when said cylinders are momentarily in said reference position defining a series of successive time periods between successively generated signals;

means for measuring the volume of drilling fluid within said tank means each time a signal is emitted from said sensing means; and means for correlating said measured volume in said tank means such that a sudden change in the successive correlated volumes measured over said series of successive time periods is indicative of a kick or drilling fluid loss.

18. A method as defined in claim 8 wherein the volume of drilling fluid in the surge means is measured by detecting the level of drilling fluid in the surge means at the time of interest.

19. A method as defined in claim 10 wherein the volume of drilling fluid in the surge means is measured by detecting the level of drilling fluid in the surge means at the time of interest.

* * * * *